US010808289B2

(12) United States Patent
Sadeghi

(10) Patent No.: US 10,808,289 B2
(45) Date of Patent: Oct. 20, 2020

(54) ANIMAL SKIN SUBSTRATE TREATMENT APPARATUS AND METHOD

(71) Applicant: Xeros LTD, Rotherham, South Yorkshire (GB)

(72) Inventor: Alireza Sadeghi, Rotherham (GB)

(73) Assignee: Xeros Limited, Rotherham, South Yorkshire (GB)

( * ) Notice: Subject to any disclaimer, the term of this patent is extended or adjusted under 35 U.S.C. 154(b) by 716 days.

(21) Appl. No.: 15/510,576

(22) PCT Filed: Oct. 8, 2015

(86) PCT No.: PCT/GB2015/052941
§ 371 (c)(1),
(2) Date: Mar. 10, 2017

(87) PCT Pub. No.: WO2016/055788
PCT Pub. Date: Apr. 14, 2016

(65) Prior Publication Data

US 2017/0240982 A1 Aug. 24, 2017

(30) Foreign Application Priority Data

Oct. 10, 2014 (GB) ..... 1418007.9

(51) Int. Cl.
*C14C 15/00* (2006.01)

(52) U.S. Cl.
CPC ..... *C14C 15/00* (2013.01)

(58) Field of Classification Search
None
See application file for complete search history.

(56) References Cited

U.S. PATENT DOCUMENTS 3,591,326 A 7/1971 Johnels
3,806,412 A 4/1974 Gagne et al.
(Continued)

FOREIGN PATENT DOCUMENTS

AU 702280 B2 2/1999
CA 868968 A 4/1971
(Continued)

OTHER PUBLICATIONS

U.S. Appl. No. 15/414,314, He et al.
(Continued)

*Primary Examiner* — Michael E Barr
*Assistant Examiner* — Jason P Riggleman
(74) *Attorney, Agent, or Firm* — Clark & Elbing LLP

(57) ABSTRACT

An apparatus for treating at least one animal skin substrate with a multiplicity of solid particles comprises a rotatably mounted drum for containing said animal substrate, said solid particulate material and a treatment liquor, said drum comprising an outlet opening and a closure. The closure can be moveable between a first position wherein said outlet opening is closed and the animal substrate, the solid particulate material and the treatment liquor cannot pass through the outlet and are retained within the drum and a second position wherein said outlet opening is open such that solid particulate material and the treatment liquor can exit the drum through the outlet opening. The drum can further comprise an apertured screen arranged at the outlet and configured to permit passage through the outlet opening of the solid particulate material and the treatment liquor when the closure is in the second position and to prevent passage thereof through the outlet opening of the animal skin substrate. The apertured screen is suitably moveable from the outlet opening to permit loading and unloading of the animal skin substrate through the outlet opening when
(Continued)

the closure is in the second position. A treatment method using the apparatus is also disclosed.

32 Claims, 5 Drawing Sheets

(56) References Cited

U.S. PATENT DOCUMENTS

| | | | |
|---|---|---|---|
| 4,221,564 | A | 9/1980 | Plapper et al. |
| 4,272,242 | A | 6/1981 | Plapper et al. |
| 5,709,714 | A | 1/1998 | Natoli et al. |
| 6,237,373 | B1 | 5/2001 | Harris et al. |
| 8,118,942 | B2 | 2/2012 | Featherson et al. |
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 10,287,642 | B2 | 5/2019 | Scott |
| 10,301,691 | B2 | 5/2019 | Feyisa et al. |
| 10,316,448 | B2 | 6/2019 | He et al. |
| 10,494,590 | B2 | 12/2019 | Abercrombie et al. |
| 10,590,499 | B2 | 3/2020 | Ashfaq et al. |
| 10,597,814 | B2 | 3/2020 | Wells et al. |
| 2004/0045092 | A1 | 3/2004 | Cassingham |
| 2005/0229354 | A1 | 10/2005 | Dinteman et al. |
| 2006/0101584 | A1 | 5/2006 | Hueffer et al. |
| 2008/0011126 | A1 | 1/2008 | Duarte et al. |
| 2008/0111269 | A1 | 5/2008 | Politi et al. |
| 2008/0251356 | A1 | 10/2008 | Bratusa et al. |
| 2009/0205142 | A1 | 8/2009 | Vorlander et al. |
| 2011/0296628 | A1 | 12/2011 | Jenkins et al. |
| 2012/0048299 | A1 | 3/2012 | Jenkins et al. |
| 2012/0284931 | A1* | 11/2012 | Jenkins ..... D06F 23/025 8/137 |
| 2012/0304400 | A1 | 12/2012 | Jenkins et al. |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2013/0340487 | A1 | 12/2013 | Yin et al. |
| 2014/0123399 | A1 | 5/2014 | Reiners et al. |
| 2014/0189961 | A1 | 7/2014 | He et al. |
| 2014/0201929 | A1 | 7/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0175945 | A1 | 6/2015 | Waddon et al. |
| 2015/0252511 | A1 | 9/2015 | Roberts et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0137983 | A1 | 5/2017 | He et al. |
| 2017/0159222 | A1 | 6/2017 | Jenkins et al. |
| 2017/0241061 | A1 | 8/2017 | Wells et al. |
| 2017/0247771 | A1 | 8/2017 | Scott |
| 2017/0267949 | A1 | 9/2017 | Bird et al. |
| 2018/0057777 | A1 | 3/2018 | Waddon et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |
| 2019/0210892 | A1 | 7/2019 | Scott et al. |
| 2019/0211288 | A1 | 7/2019 | Potts et al. |
| 2019/0233760 | A1 | 8/2019 | Lavery et al. |
| 2020/0002650 | A1 | 1/2020 | Servin et al. |

FOREIGN PATENT DOCUMENTS

| | | | | |
|---|---|---|---|---|
| CN | 1031113 | A | 2/1989 | |
| CN | 1036408 | A | 10/1989 | |
| CN | 1065097 | A | 10/1992 | |
| CN | 2310074 | Y | 3/1999 | |
| CN | 101360837 | A * | 2/2009 | ..... C14C 3/06 |
| CN | 101360837 | A | 2/2009 | |
| CN | 102061589 | A | 5/2011 | |
| CN | 202175862 | U | 3/2012 | |
| CN | 102425053 | A | 4/2012 | |
| CN | 102425055 | A | 4/2012 | |
| CN | 202214631 | U | 5/2012 | |
| CN | 202214633 | U | 5/2012 | |
| CN | 202298219 | U | 7/2012 | |
| CN | 202298220 | U | 7/2012 | |
| CN | 202298222 | U | 7/2012 | |
| CN | 202298235 | U | 7/2012 | |
| CN | 202323458 | U | 7/2012 | |
| CN | 202359387 | U | 8/2012 | |
| CN | 202359388 | U | 8/2012 | |
| CN | 202359389 | U | 8/2012 | |
| CN | 202359390 | U | 8/2012 | |
| CN | 202359396 | U | 8/2012 | |
| CN | 202492706 | U | 10/2012 | |
| CN | 102782199 | A | 11/2012 | |
| CN | 202543634 | U | 11/2012 | |
| CN | 202543635 | U | 11/2012 | |
| CN | 202543646 | U | 11/2012 | |
| CN | 202543652 | U | 11/2012 | |
| CN | 102899848 | A | 1/2013 | |
| CN | 202688698 | U | 1/2013 | |
| CN | 202755220 | U | 2/2013 | |
| CN | 202755221 | U | 2/2013 | |
| CN | 102953249 | A | 3/2013 | |
| CN | 102953250 | A | 3/2013 | |
| CN | 102953262 | A | 3/2013 | |
| CN | 102978870 | A | 3/2013 | |
| CN | 103061084 | A | 4/2013 | |
| CN | 103061085 | A | 4/2013 | |
| CN | 103061086 | A | 4/2013 | |
| CN | 103061087 | A | 4/2013 | |
| CN | 103087839 | A | 5/2013 | |
| CN | 103103720 | A | 5/2013 | |
| CN | 103103721 | A | 5/2013 | |
| CN | 103122566 | A | 5/2013 | |
| CN | 103122567 | A | 5/2013 | |
| CN | 202913242 | U | 5/2013 | |
| CN | 202989172 | U | 6/2013 | |
| CN | 103225192 | A | 7/2013 | |
| CN | 203049283 | U | 7/2013 | |
| CN | 103361934 | A | 10/2013 | |
| CN | 103361938 | A | 10/2013 | |
| CN | 203370359 | U | 1/2014 | |
| CN | 102061588 | B | 2/2014 | |
| CN | 103556439 | A | 2/2014 | |
| CN | 203530695 | U | 4/2014 | |
| CN | 203530700 | U | 4/2014 | |

(56) References Cited

FOREIGN PATENT DOCUMENTS

| | | | | |
|---|---|---|---|---|
| CN | 203530714 | U | | 4/2014 |
| CN | 203530718 | U | | 4/2014 |
| CN | 203530723 | U | | 4/2014 |
| CN | 203530725 | U | | 4/2014 |
| CN | 103285643 | B | | 4/2015 |
| CN | 103451894 | B | | 11/2015 |
| CN | 103556434 | B | | 11/2015 |
| CN | 103556436 | B | | 11/2015 |
| CN | 103556431 | B | | 1/2016 |
| CN | 103556432 | B | | 3/2016 |
| CN | 105420992 | A | | 3/2016 |
| CN | 105420993 | A | | 3/2016 |
| CN | 105421000 | A | | 3/2016 |
| CN | 105442267 | A | | 3/2016 |
| CN | 205329373 | U | | 6/2016 |
| CN | 205329374 | U | | 6/2016 |
| CN | 205329380 | U | | 6/2016 |
| CN | 205329384 | U | | 6/2016 |
| EP | 0439108 | A1 | | 7/1991 |
| EP | 0306236 | B1 | | 4/1993 |
| GB | 498506 | A | | 1/1939 |
| GB | 592707 | | * | 9/1947 |
| GB | 874232 | A | | 8/1961 |
| GB | 1186368 | A | | 4/1970 |
| GB | 1332999 | A | | 10/1973 |
| GB | 1481508 | A | | 8/1977 |
| GB | 2287953 | A | | 10/1995 |
| JP | H01318100 | A | | 12/1989 |
| JP | H09-512573 | A | | 12/1997 |
| JP | 2003017457 | A | | 1/2003 |
| JP | 2009148699 | A | | 7/2009 |
| KR | 10-0237982 | B1 | | 3/2000 |
| KR | 20-0292892 | Y1 | | 10/2002 |
| RO | 98565 | B1 | | 3/1990 |
| RU | 2206619 | C1 | | 6/2003 |
| SU | 720020 | A1 | | 3/1980 |
| WO | WO-88/10317 | A1 | | 12/1988 |
| WO | WO-02/12569 | A1 | | 2/2002 |
| WO | WO-2004/061136 | A1 | | 7/2004 |
| WO | WO-2007/128962 | A1 | | 11/2007 |
| WO | WO-2009/153345 | A2 | | 12/2009 |
| WO | WO-2010/094959 | A1 | | 8/2010 |
| WO | WO-2011/064581 | A1 | | 6/2011 |
| WO | WO-2011/098815 | A1 | | 8/2011 |
| WO | WO-2011/128676 | A1 | | 10/2011 |
| WO | WO-2012/056252 | A2 | | 5/2012 |
| WO | WO-2012/095677 | A2 | | 7/2012 |
| WO | WO-2014/006425 | A1 | | 1/2014 |
| WO | WO-2014/080192 | A1 | | 5/2014 |
| WO | WO-2014/147391 | A1 | | 9/2014 |

OTHER PUBLICATIONS

U.S. Appl. No. 15/510,569, Xeros Ltd.
U.S. Appl. No. 15/513,014, Xeros Ltd.
U.S. Appl. No. 15/513,309, Xeros Ltd.
Afsar et al., "An investigation about the effect of oxazolidine on modified valonia extract tanning," African Journal of Biotechnology. 7(20):3737-42 (2008).
International Search Report and Written Opinion for International Application No. PCT/GB2015/052941, dated Jan. 18, 2016 (8 pages).
Jing et al., "A novel oxazolidine tanning agent and its use in vegetable combination tanning," The Journal of the Society of Leather Technologists and Chemists 95(4):165-70 (2011).
Musa et al., "Studies on combination tanning based on henna and oxazolidine," The Journal of the American Leather Chemist's Association 104(10):335-43 (2009).
Search Report for United Kingdom Application No. GB1418007.9, dated May 1, 2015 (6 pages).
U.S. Appl. No. 15/518,047, Xeros Ltd.
U.S. Appl. No. 15/532,137, Xeros Ltd.
U.S. Appl. No. 16/497,070, Xeros Ltd.
Hudson et al, "Leather coloration," Rev. Prog. Coloration. 30: 67-75 (2000).
Inter Abrasiv Sanayi Ve Ticaret A.S., Safety Data Sheet for "SIC waterproof sanding sheets," published Mar. 2005, revised May 2015 (4 pages).
Shukla et al., "Immobilisation of amylase by various techniques," Indian Journal of Fibre & Textile Research. 29:75-81 (2005).

* cited by examiner

ANIMAL SKIN SUBSTRATE TREATMENT APPARATUS AND METHOD

This invention relates to an improved method and apparatus for the treatment of animal skin substrates which employs a solid particulate material (also referred to herein as "a multiplicity of solid particles"). Particularly, the invention provides a method and apparatus for separating the solid particulate material from the animal skin substrates during or after the treatment process. Preferably, the animal skin substrates can be a hide or a pelt. The animal skin substrates can be subjected to one or more processes to form leather.

BACKGROUND

Current methods for treating or processing animal skin substrates can necessitate the use of vast quantities of water. For example, in treatment methods wherein the animal skin substrate comprises a hide, typically 30 kg of water is required per kg of hide. Large volumes of water can be needed in order to remove unwanted materials from the animal skin (such as those that are liable to decomposition) and also in subsequent steps of the process which involve chemical modification to confer certain properties on the substrate. Chemical modification of the substrate can be carried out for the purpose of, inter alia, preserving, waterproofing, colouring and/or providing any desired textural or aesthetic qualities. The various steps described above will generally be performed in the presence of a treatment formulation comprising one or more components.

Due to the large amounts of water relative to the weight of animal substrate, current treatment processes known in the art also require a proportionate quantity of chemicals used in the treatment formulation to ensure an effective treatment of the substrate within an acceptable timeframe. Consequently, excessive amounts of polluting and environmentally damaging effluents can be produced from such processes. Furthermore, long process times are necessary.

Many of the methods for preparing animal skin substrates for human use still remain predominantly based on traditional processes and there have been few advances in recent years. For example, methods for the processing and manufacturing of leather have remained largely unchanged for 75 years. EP0439108 filed in 1991 and directed to a process using carbon dioxide for deliming of hides, discloses an example of one of the few recent developments in this field.

Prior to the innovations disclosed herein, the inventors have previously addressed the problem of reducing water consumption in a domestic or industrial cleaning method, primarily in relation to laundry. Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. The soiled substrate can be wetted so as to achieve a substrate to water ratio of between 1:0.1 to 1:5 w/w, and optionally, the formulation can additionally comprise at least one cleaning material, which typically comprises a surfactant, which most preferably has detergent properties. The soiled substrate may comprise a textile fibre. The polymeric particles can, for example, comprise particles of polyamides, polyesters, polyalkenes, polyurethanes or their copolymers, a particular example being nylon beads.

Following the development of this method the present applicant further devised an apparatus specially adapted to clean soiled substrates by virtue of recirculation of the polymeric particles. Thus, in WO2011/098815, the present applicant provided an apparatus for use in the cleaning of soiled substrates (primarily laundry), the apparatus comprising housing means having a first upper chamber with a rotatably mounted cylindrical cage mounted therein and a second lower chamber located beneath the cylindrical cage, and additionally comprising at least one recirculation means, access means, pumping means and a multiplicity of delivery means, wherein the rotatably mounted cylindrical cage comprises a drum having perforated side walls where up to 60% of the surface area of the side walls comprises perforations comprising holes having a diameter of no greater than 25.0 mm.

Although the method and apparatus disclosed in WO2007/128962 and WO2011/098815 provided considerable improvements for the cleaning of soiled substrates these developments were primarily applicable to the field of laundry wherein the substrate typically comprises textile fibre garments. The method and apparatus of WO2007/128962 and WO2011/098815 (so-called "bead cleaning" technologies) were not however specifically adapted or optimised for the treatment of animal skin substrates.

The present disclosure therefore seeks to provide an apparatus and method for use in the treatment of animal skin substrates that can ameliorate or overcome at least some of the above-noted problems associated with the prior art. Particularly, there is desired a method and apparatus for treating an animal skin substrate which can require less water than the processes of the prior art and which can reduce the volume of polluting and hazardous effluent produced. Furthermore, there is desired a method and apparatus for treating an animal skin substrate with a solid particulate material which can provide an effective means of separating the solid particulate material from the substrate.

BRIEF SUMMARY OF THE DISCLOSURE

There is described herein an apparatus for treating at least one animal skin substrate with a solid particulate material, the apparatus comprising a rotatably mounted drum for containing said animal substrate, said solid particulate material and a treatment liquor, said drum comprising an outlet opening an apertured screen arranged at the outlet opening and configured to permit passage through the outlet opening of the solid particulate material and the treatment liquor and to prevent passage through the outlet opening of the animal skin substrate, and a closure moveable between a first position at which the closure closes said outlet opening such that the animal substrate, the solid particulate material and the treatment liquor cannot pass through the outlet and a second position at which said outlet opening is open such that solid particulate material and the treatment liquor can exit the drum through the outlet opening.

Preferably, the apertured screen is moveable from the outlet opening to permit loading and unloading of the animal skin substrate through the outlet opening when the closure is in the second position. In typical preferred arrangements the apertured screen can be hinged or slidable.

The interior of the drum can be considered to be a treatment volume within which from time to time, one, some or all of the animal skin substrate, the treatment liquor and the solid particulate material are contained during the treatment performed in the apparatus. The contents of the treatment volume at any given time can depend on a particular stage or phase of the treatment which has been reached.

Thus, preferably said rotatably mounted drum comprises therein the solid particulate material. Treatment liquor can be present in the drum with the solid particulate material.

It will therefore be appreciated by the skilled person that the rotatably mounted drum is non-perforated and thus able to retain fluid.

Preferably, said solid particulate material which can be present in the drum has an average particle diameter of from 1 mm to 100 mm, preferably from 1 to 50 mm or 1 to 25 mm or 1 to 15 mm or 1 to 10 mm or 2 to 8 mm or 4 to 8 mm or 5 to 7 mm.

Preferably, said solid particulate material can have a particle length of from 1 mm to 100 mm. The solid particulate material can have a particle length of from 1 to 50 mm or 1 to 25 mm, or from 1 to 15 mm or from 1 to 10 mm, or from 2.0 to 8.0 mm, or from 4.0 to 7.0 mm, or from 5.0 to 7.0 mm, or from 1.0 to 5.0 mm or from 2.5 to 4.5 mm.

The person of ordinary skill will however understand that the diameter and length of the particles of the solid particulate material are to be selected in accordance with the maximum dimension of the apertures in the apertured screen to ensure that the solid particulate material can pass freely through the apertured screen.

Preferably, the drum is a substantially cylindrical drum comprising a substantially cylindrical side wall and opposed end walls and wherein the outlet opening is arranged in said cylindrical side wall.

In other preferred embodiments the drum can be polygonal in cross section perpendicular to its rotational axis, the outlet opening being formed in a side wall.

Preferably, the drum is configured to rotate about a substantially horizontal axis.

Preferably, the apparatus further comprises a drive arrangement configured to rotate the drum and a drive controller configured to control the operation of the drive arrangement.

Preferably, the drive controller is configured to rotate the drum through at least one complete rotation about its rotational axis. Preferably phases or cycles of a treatment process using the apparatus of the invention can include a plurality of complete rotations. Certain phases or cycles can, however comprise partial rotations, that is through less than 360°. For example forward and reverse rotations may in some phases be effected with the outlet opening located primarily below the axis of rotation.

The drive controller can be configured or programmed to cause the drum to rotate for a determined period of time or number of rotations or for a sequence of rotations including different times, direction and speeds of rotation, for example.

The drive controller can be part of an overall apparatus controller. The apparatus controller can control the movement of the closure between the first and second positions. Preferably, an actuator, such as a hydraulic actuator is provided to effect opening and closing of the closure, that is, movement of the closure between the first and second positions. The apparatus controller can control the operation of the actuator. Of course, an actuator controller distinct from the apparatus controller can be provided.

Preferably, the apertured screen is a reticulate screen or a perforate screen.

Preferably, said apertured screen comprises a plurality of apertures. The apertures are sized to allow passage of solid particulate material therethrough and to prevent the passage of animal skin substrates therethrough.

Preferably, the apertures of the apertured screen have a maximum dimension of from about 2 to 125 mm, from about 2 to 100 mm, from about 2 to 75 mm, from about 2 to 50 mm, from about 2 to about 35 mm, from about 2 to 26 mm, from about 2 to 25 mm, from about 2 to about 10 mm or from about 6 to about 10 mm. Optionally, said apertures have a maximum dimension of about 10 mm or about 5 mm or about 2 mm, or a maximum dimension of from about 26 mm to about 125 mm.

The apertured screen is configured to support the weight of said animal skin substrates, at least when the closure is in the second (open) position. In one typical arrangement the treatment volume can contain animal substrates with a combined weight of up to 50,000 kg. The treatment volume can contain animal substrates with a combined weight of from about 50 to about 50,000 kg, or from about 500 to about 30,000 kg, or from about 1000 kg to about 25,000 kg, or from about 2000 to about 20,000 kg, or from about 2500 to about 10,000 kg.

Preferably, said apertured screen comprises metal, metal alloy, plastic, fibreglass composite or polymeric materials. Typically the apertured screen is corrosion resistant. Said apertured screen is resistant to any chemicals or additives with corrosive properties which may be present in the treatment liquor. Preferably, said apertured screen comprises steel, especially stainless steel.

Preferably, the closure comprises a slidably arranged door which is slidably moveable between the first position in which the door covers the outlet opening and a second position in which the door partially covers the outlet opening or does not cover the outlet opening.

Preferably, the apparatus can further comprise a storage vessel arranged externally of the drum to retain solid particulate material prior to entry thereof into the drum and/or to retain solid particulate material recovered from the drum.

Preferably, the apparatus further comprises a feed conduit extending from the storage vessel to the drum and a control arrangement to control the feed of solid particulate material from the storage vessel to the drum.

Preferably, the apparatus further comprises a jacket or casing arranged externally of the drum at at least a lower portion thereof and configured to receive solid particulate material exiting the drum through the outlet opening.

Preferably, the apparatus further comprises a collection vessel arranged below the jacket or casing and communicating therewith to collect solid particulate material which has exited the drum.

Preferably, the apparatus further comprises a transport conduit configured to transport solid particulate material from the collection vessel to the storage vessel. Preferably, the transport conduit also conveys treatment liquor towards a separator. The transport conduit can include a pumping device which can pump the solid particulate material and treatment liquor through the transport conduit. Preferably, said pumping device is arranged in a circulation path external to the drum. The circulation path is defined hereinbelow. Preferably, said pumping device is located downstream, particularly immediately downstream, of said collecting vessel.

Preferably, the apparatus further comprises at least one product inlet distinct from the outlet opening and configured for the supply of solid particulate material and/or treatment liquor into the drum.

Preferably, the animal skin substrate is a hide or a pelt.

Preferably, the solid particulate material is re-used one or more times for treatment of the animal substrates in, with or by the apparatus of the invention. The circulation path defined herein below facilitates re-use of the solid particles as does the storage vessel. Preferably, the solid particles is re-used at least two, three, four, five or more times, such as 10, 20, 50 or 100 or more times, for treatment of the animal substrates in, with or by the apparatus of the invention. The solid particles are typically not re-used more than 10,000 or more than 1,000 times.

According to a first aspect of the invention, there is provided an apparatus for treating at least one animal skin substrate with a solid particulate material, the apparatus comprising a rotatably mounted drum for containing said animal substrate, said solid particulate material and a treatment liquor, said drum comprising an outlet opening an apertured screen arranged at the outlet opening and configured to permit passage through the outlet opening of the solid particulate material and the treatment liquor and to prevent passage through the outlet opening of the animal skin substrate, a closure moveable between a first position at which the closure closes said outlet opening such that the animal substrate, the solid particulate material and the treatment liquor cannot pass through the outlet and a second position at which said outlet opening is open such that solid particulate material and the treatment liquor can exit the drum through the outlet opening;

wherein the apparatus further comprises a jacket or casing arranged externally of the drum at at least a lower portion thereof and configured to receive solid particulate material exiting the drum through the outlet opening; and wherein the apparatus further comprises a collection vessel arranged below the jacket or casing and communicating therewith to collect solid particulate material which has exited the drum.

According to a second aspect of the present invention there is provided a method of treating at least one animal skin substrate comprising agitating, for at least a first time period, the animal skin substrate with a solid particulate material and a treatment liquor in a rotatably mounted drum, opening an outlet opening of the drum agitating the animal skin substrate in the drum for a second time period, the drum further comprising an apertured screen arranged at the outlet and configured such that during said second time period solid particulate material and treatment liquor exit the drum through the outlet opening and the at least one animal skin substrate is retained in the drum, and collecting said solid particulate material in a collecting vessel.

In the second aspect of the invention, the drum is preferably a part of an apparatus as described herein, and preferably an apparatus according to the first aspect of the invention. The drum in the second aspect of the invention can have any feature, or permitted combination of features, described or defined above in relation to the apparatus described herein and particularly in relation to the apparatus of the first aspect of the invention.

The solid particulate material of the second aspect of the invention is preferably as defined in any of the relevant embodiments of the apparatus described herein and particularly in the apparatus of the first aspect of the invention and/or in any of the below-mentioned embodiments.

Preferably, the opening of the outlet opening comprises moving a closure arranged on the drum from a closed first position in which the closure covers the outlet opening to an open second position in which the outlet opening is partially covered by the closure or is not covered by the closure.

Preferably, the closure is slidably arranged on the drum. The closure can be a door; the door can be slidably arranged on the drum.

Preferably, said agitating comprises rotating the drum about a substantially horizontal axis.

Preferably, the method comprises transferring the collected solid particulate material from the collecting vessel to a storage vessel.

Preferably, the solid particulate material is transferred with treatment liquor collected by the collecting vessel.

Preferably, the method further comprises transferring the solid particulate material and the treatment liquor to a separation device and separating the solid particulate material from the treatment liquor in the separation device.

Preferably, the separation device is arranged in the storage vessel and the method can further comprise retaining the separated solid particulate material in the storage vessel and discharging the treatment liquor from the storage vessel.

Preferably, the method further comprises during said first and/or second time periods, returning, intermittently or continuously, at least some of the discharged treatment liquor to the interior of the drum via an inlet port of the drum.

Preferably, the method further comprises, during said first time period, returning, intermittently or continuously, at least some of the discharged solid particulate material to the interior of the drum via an inlet port of the drum.

Preferably, the method further comprises treating solid particulate material collected by said collecting vessel to remove residual treatment liquor and/or residue of the animal skin substrate.

Preferably, said treating of the solid particulate material is effected before the solid particulate material reaches the storage vessel.

Preferably, the solid particulate material collected in the collecting vessel is re-used for the treatment of the animal skin substrate in the same treatment method or for the treatment of further animal skin substrates in subsequent treatments according to the method.

Thus, in the second aspect of the invention the solid particulate material is preferably re-used one or more times for treatment of the animal skin substrates or further animal skin substrates in accordance with the method of the second aspect of the invention. Such re-use or re-uses is/are preferably in an apparatus described herein and preferably in an apparatus according to the first aspect of the invention. The circulation path defined herein below facilitates re-use of the solid particles as does the storage vessel. Preferably, the solid particles are re-used at least two, three, four, five or more times, such as 10, 20, 50 or 100 or more times, for treatment of the animal substrates in, with or by the apparatus of the invention. The solid particles are typically not re-used more than 10,000 or more than 1,000 times.

Preferably, the method further comprises retrieving the animal skin substrate from the collecting vessel and subjecting the substrate to a secondary solid particulate material removal process for the separation of residual solid particulate material from the animal skin substrate.

Preferably, the secondary solid particulate material removal process comprises passing the animal skin substrate between opposed rotating cylindrical brushes or subjecting the solid particulate material on the animal skin substrate to removal by suction with a suction device.

Advantageously, the present invention employs a multiplicity of solid particles (also referred to herein as a solid particulate material) which can confer a more uniform and enhanced or effective mechanical action on the animal skin substrate when the drum is rotated. This can reduce the duration of the necessary treatment cycle providing improvements in efficiency over processes of the prior art. By virtue of the inclusion of the multiplicity of solid particles, the invention can facilitate the use of only limited amounts of treatment liquor (which typically comprises at least some water) thereby offering significant environmental benefits compared to standard processes commonly employed in this field. As the quantity of treatment liquor needed by the invention can be significantly reduced, the amount of chemicals relative to a given quantity of substrate in order to provide an effective treatment of the animal skin substrates can be decreased. Furthermore, the apertured screen provided on the drum according to the invention provides an efficient means of separating solid particles from animal skin substrates within the drum. Effective separation of solid particles from the substrates improves the efficiency and/or efficacy of the treatment and increases the number of available particles for use in an ongoing treatment cycle or for subsequent treatment cycles. Advantageously, the invention is able to achieve separation of solid particles from the animal skin substrates with a separation efficiency of greater than 75%, such as greater than 80%, or 85%, or 90%.

As described herein, "treatment liquor" comprises a liquid medium used in the apparatus or treatment process of the invention. Preferably said treatment liquor comprises water or water when combined with at least one treatment agent and/or any further additives as detailed further hereinbelow.

As noted above, the or each animal skin substrate is preferably a hide or a pelt. The treatment process using the apparatus of the invention can be a process in the production of leather. The hide or pelt can be subjected to one or more additional process steps in the production of leather before or after the treatment process using the apparatus of the invention. The hide or pelt can be a processed or unprocessed animal skin substrate.

In the second aspect of the invention, there is preferably provided a circulation path for the solid particulate material and for the treatment liquor. The respective circulation paths can be a common path, or paths having common portions. A circulation path for the solid particulate material can be from the drum to the collecting vessel and then to a separator, which can be within a storage vessel. The circulation path of the solid particulate material can continue from the storage vessel to the drum interior via a suitable drum inlet which can preferably be other than the outlet opening of the drum. A circulation path for the treatment liquor can be from the drum to the collecting vessel and then to a separator, which can be within a storage vessel. The circulation path of the treatment liquor can continue from the storage vessel to the drum interior optionally via a suitable liquor storage vessel. The treatment liquor circulation path can enter the drum via a suitable drum inlet which can preferably be other than the outlet opening of the drum. The portion of the respective circulations paths of the solid particulate material and the treatment liquor between the drum and the separator can be a common portion.

By virtue of the treatment liquor circulation path, a flow of treatment liquor through the drum can be provided in appropriate phases or cycles of the treatment method. Such flow of treatment liquor, preferably with continuing agitation of said animal substrates in said drum can be effective in achieving a desired separation of solid particles from said animal substrates.

Preferably, said apparatus comprises a processing system wherein said processing system receives said treatment liquor and said solid particles from the collecting vessel. The processing system can preferably be arranged in the circulation path of the solid particulate material.

Preferably, said separator configured to separate said treatment liquor from said solid particles is a part of the processing system.

The separation of treatment liquor from the solid particles can facilitate the effective re-use of the solid particulate material.

Preferably, said processing system comprises a device for removing residual treatment liquor and deposits from said solid particulate material. Said deposits can be derived from said animal skin substrates. The device can carry out one or more washing or rinsing stages. In this way residual treatment liquor and deposits can be removed from the solid particulate material, preferably before the solid particulate material is conveyed to the storage vessel or re-introduced to the treatment volume of the drum.

Preferably, said processing system comprises one or more outlets for discharging treatment liquor and/or unwanted matter produced during the treatment process.

Preferably, said solid particles have an average particle diameter of from 1 mm to 100 mm, or from 1 to 50 mm or 1 to 25 mm or 1 to 15 mm or 1 to 10 mm or 2 to 8 mm or 4 to 8 mm or 5 to 7 mm.

Preferably, said solid particles have a length of from 1 mm to 100 mm, or from 1 to 50 mm or 1 to 25 mm, or from 1 to 15 mm or from 1 to 10 mm, or from 2.0 to 8.0 mm, or from 4.0 to 7.0 mm, or from 5.0 to 7.0 mm, or from 1.0 to 5.0 mm or from 2.5 to 4.5 mm.

The skilled person will however understand that the diameter and length of the particles of the solid particulate material are to be selected in accordance with the maximum dimension of the apertures in the apertured screen to ensure that the solid particles can pass freely through the screen.

Preferably, the solid particles are spheroidal, spherical or ellipsoidal.

Preferably, the solid particulate material comprises a multiplicity of polymeric particles.

Preferably, the solid particulate material comprises a multiplicity of non-polymeric particles.

Preferably, the solid particulate material comprises a mixture of a multiplicity of polymeric and non-polymeric particles.

Preferably, the polymeric or non-polymeric particles comprises or is in the form of beads.

Preferably, the polymeric particles have an average density of about 0.5 g/cm$^3$ to about 3.5 g/cm$^3$ and preferably about 0.5 to 2.5 g/cm$^3$. Alternatively, the polymeric particles can have an average density of 0.5 to less than 1 g/cm$^3$.

Preferably, the polymer of the polymeric particles comprises polyalkenes, polyamides, polyesters, polysiloxanes, polyurethanes or copolymers thereof.

The polymer of the polymeric particles can comprise polyalkenes or polyurethanes, or copolymers thereof.

The polymer of the polymeric particles can comprise polyamide or polyester or copolymers thereof.

Said polyamide can comprise nylon. The polyamide can comprise Nylon 6 or Nylon 6,6.

The polyester can comprise polyethylene terephthalate or polybutylene terephthalate.

Preferably, the non-polymeric particles comprise ceramic material, refractory material, igneous, sedimentary or metamorphic minerals, composites, metal, glass or wood.

Preferably, the non-polymeric particles have an average density of 0.5 to 20 g/cm$^3$, more preferably from 2 to 20 g/cm$^3$, especially from 4 to 15 g/cm$^3$ and most especially from 4 to 10 g/cm$^3$.

Preferably, said drum has a capacity of from 500 to 200,000 litres.

Preferably, the drum has a treatment volume in which treatment of the animal skin substrate is effected. In methods according to the invention, the treatment volume can have an ullage volume of at least 10% by volume, or at least 20% by volume, and more preferably from 30 to 70% or from 30 to 60% by volume. These ullage volumes can be effective in order to provide for efficient mixing whilst maximising the utilisation capacity of the apparatus. The drum can be constructed (for example in terms of its internal capacity) to achieve desired ullage volumes with a loading of animal skin substrate typical in the art.

Preferably, said method comprises the steps of:

introducing treatment liquor into the drum and agitating said animal skin substrates with said solid particles and said treatment liquor in the treatment volume for a first agitation step; allowing said treatment liquor to pass through the apertured screen to the collecting vessel and conveying said treatment liquor from the collecting vessel along a circulation path; and re-introducing said treatment liquor from said circulation path into said treatment volume.

Thus, advantageously, the method of the invention permits re-use of the treatment liquor in more than one phase or for multiple agitation steps with the animal substrates within a given treatment cycle.

Preferably, said circulation path is external to said drum.

Preferably, the method comprises extracting effluent and/or unwanted matter from the treatment liquor received from the collecting vessel before re-introducing said treatment liquor into the drum.

Preferably, said method comprises the steps of:

introducing said solid particles into the drum and agitating said animal skin substrates with said solid particles and said treatment liquor in the treatment volume for a first agitation step; allowing said solid particles to pass through the apertured screen to the collecting vessel and conveying said solid particles from the collecting vessel along a circulation path, re-introducing said solid particles into the drum from said circulation path and agitating said animal skin substrates with said solid particles and treatment liquor in the drum for a second or subsequent agitation step. After a second or subsequent agitation step the closure can be opened so that, on further agitation, the solid particulate material can exit the drum through the outlet opening.

Thus, advantageously, the method of the invention permits re-use of the solid particulate material in more than one phase or for multiple agitation steps with the animal skin substrates within a typical treatment cycle.

Preferably, the method further comprises separating at least a portion of said treatment liquor from said solid particulate material before re-introducing said solid particulate into the drum for a second or subsequent agitation step.

Preferably, the method further comprises subjecting the solid particulate material to a cleaning operation using a cleaning formulation before re-introducing said solid particulate material into the drum for a second or subsequent agitation step.

Thus, advantageously, subjecting the solid particulate material to a cleaning operation can extend their usable lifetime for use multiple agitation steps.

Preferably, the treatment of the animal skin substrate in the apparatus described herein (preferably the apparatus of the first aspect of the invention) and/or according to the method of the second aspect of the invention is a tannery process.

Preferably, said tannery process is selected from one or more of cleaning, curing, beamhouse treatments, tanning, re-tanning, fat liquoring, enzyme treatment, dyeing and dye fixing.

Typical beamhouse treatments include soaking, liming, deliming, reliming, unhairing, fleshing, bating, degreasing, scudding, bating, pickling and depickling.

Preferably, said treatment process is a process used in the production of leather.

Preferably, said process used in the production of leather includes one or more of: curing, beamhouse treatments, fat liquoring, pretanning, tanning, retanning, tawing, crusting and dyeing.

Preferably, said drum is caused to rotate at a speed of from about 1 to about 15 rpm.

Particularly wherein the treatment process is a beamhouse or a tanning or a retanning or a fatliquoring or a dyeing process, the drum is caused to rotate at a speed of from about 3 to about 14 rpm. Where the treatment process is a beamhouse or a tanning process or a retanning or a fatliquoring or a dyeing process, the drum may be caused to rotate at a speed of from about 5 and 13 rpm. Where the treatment process is a beamhouse or a tanning or a retanning or a fatliquoring or a dyeing process, the drum may be caused to rotate at a speed of from about 8 and 12 rpm.

Particularly wherein the treatment process is a beamhouse process, the drum is caused to rotate at a speed of from about 9 to about 14 rpm.

Particularly wherein the treatment process is a beamhouse or a tanning or a retanning or a fatliquoring or a dyeing process, the drum is caused to rotate at a speed of not more than 15 rpm, or not more than 13 rpm, or not more than 12 rpm, or not more than 10 rpm, or not more than 8 rpm, or not more than 6 rpm, or not more than 5 rpm, or not more than 4 rpm, or not more than 3 rpm or not more than 1 rpm.

Preferably, the treatment liquor is aqueous. The treatment liquor can comprise at least 0.1% w/w water, or at least 1% w/w water, or at least 5% w/w water, or between 5% and 99.9% w/w water. The treatment liquor can comprise not more than 99.9% w/w water. Minor amounts of organic solvents (preferably less than 10% w/w, more preferably less than 5% w/w) can be present in the treatment liquor however they are preferably absent.

Alternatively, the treatment liquor is substantially free from water except for that originating from the or each animal substrate. Thus the treatment liquor can be substantially free from water except from that derived from any latent fluid present within the animal skin substrate(s) itself. Thus, water can be carried into the drum originating from the animal skin substrate. In a further embodiment, the treatment liquor is substantially free from water.

Preferably, said treatment liquor comprises at least one treatment agent selected from tanning agents, re-tanning agents and tannery process agents.

Preferably, said treatment liquor comprises at least one colourant.

Preferably, said colourant is selected from one or more dyes, pigments, optical brighteners or mixtures thereof.

BRIEF DESCRIPTION OF THE DRAWINGS

For a better understanding of the invention and to show how the same may be carried into effect, reference will be made, by way of example only, to the following drawings, in which.

DETAILED DESCRIPTION

Figure 1:
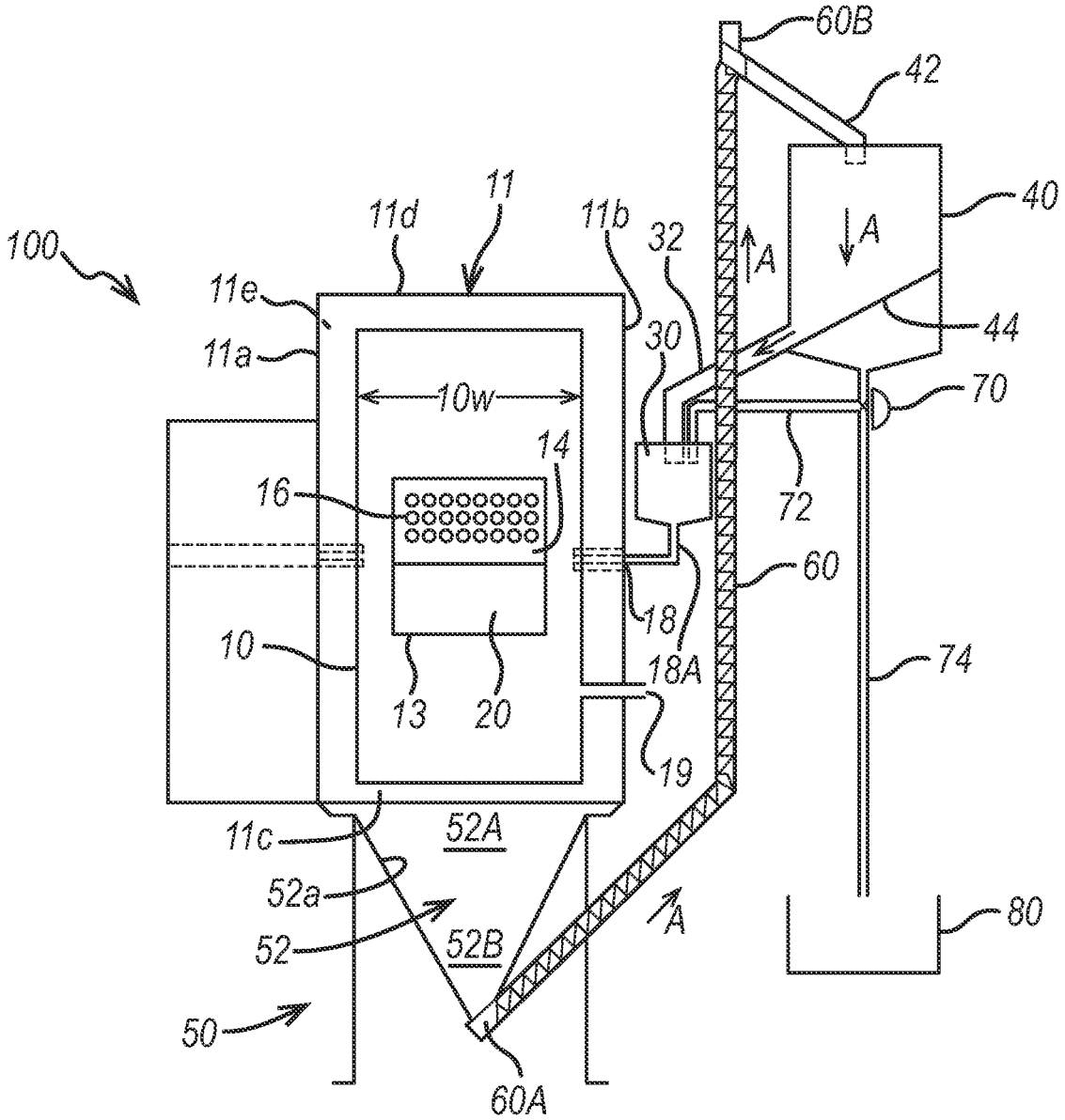
FIG. 1 is a schematic view of the apparatus for removing solid particulate material from animal skin substrates according to the invention.

The apparatus and method of the invention employs a solid particulate material (also referred to herein as a multiplicity of solid particles) for use in the treatment of an animal substrate. The use of the apparatus and method of the invention can enable the modification or transformation of the properties of the animal substrate prior to further treatment or processing of the substrate to form a manufactured article. The invention thus encompasses treatment steps performed on hides, pelts and the like before the substrate is prepared for consumer, domestic and/or industrial purposes (for example, in clothing (e.g. shoes and trainers), upholstery or automotive industries).

Notably, the treatment performed by the invention is distinguished from processes such as "laundering" wherein the substrate is typically a finished garment or fabric (being a manufactured article) and wherein the treatment merely relates to removing stains, soil and other unwanted matter from the surface of the substrate. Separation of solid particles from animal skin substrates is complicated by the texture and composition of the substrate which typically comprises a soft, fleshy tissue. The soft, fleshy nature of such substrates increases the likelihood that solid particles, when agitated with the substrate in a rotating drum, are more likely to adhere to the substrate surface or become embedded therein. The present invention therefore seeks to provide a treatment apparatus and method that remedies the deficiencies of the water intensive processes for treating animal skin substrates of the prior art and which also provides a practical and effective way of separating solid particles from the substrate.

Referring now to the drawings, the method of the invention is performed in an apparatus 100 comprising a drum 10. In use of the apparatus 100 the drum 10 contains the animal substrates being treated. The drum 10 is mounted for rotation about an axis and the animal substrates are brought into contact with solid particulate material, treatment liquor including any treatment agents and/or further additives as may be desirable within the drum 10. Typically, the drum 10 is mounted for rotation about a horizontal axis.

The drum 10 has an access means through which the animal substrates to be treated can be loaded into the drum 10 and through which the treated substrate can be removed after the treatment process. The access means can be provided with a suitable closure arranged for movement between open and closed configurations. When the closure of the access means is moved to an open position, access is permitted to place one or more animal skin substrates for treatment inside the drum 10. When the closure of the access means is moved to a closed position, the animal skin substrates are prevented from leaving the drum 10 as the drum rotates.

Figure 2:
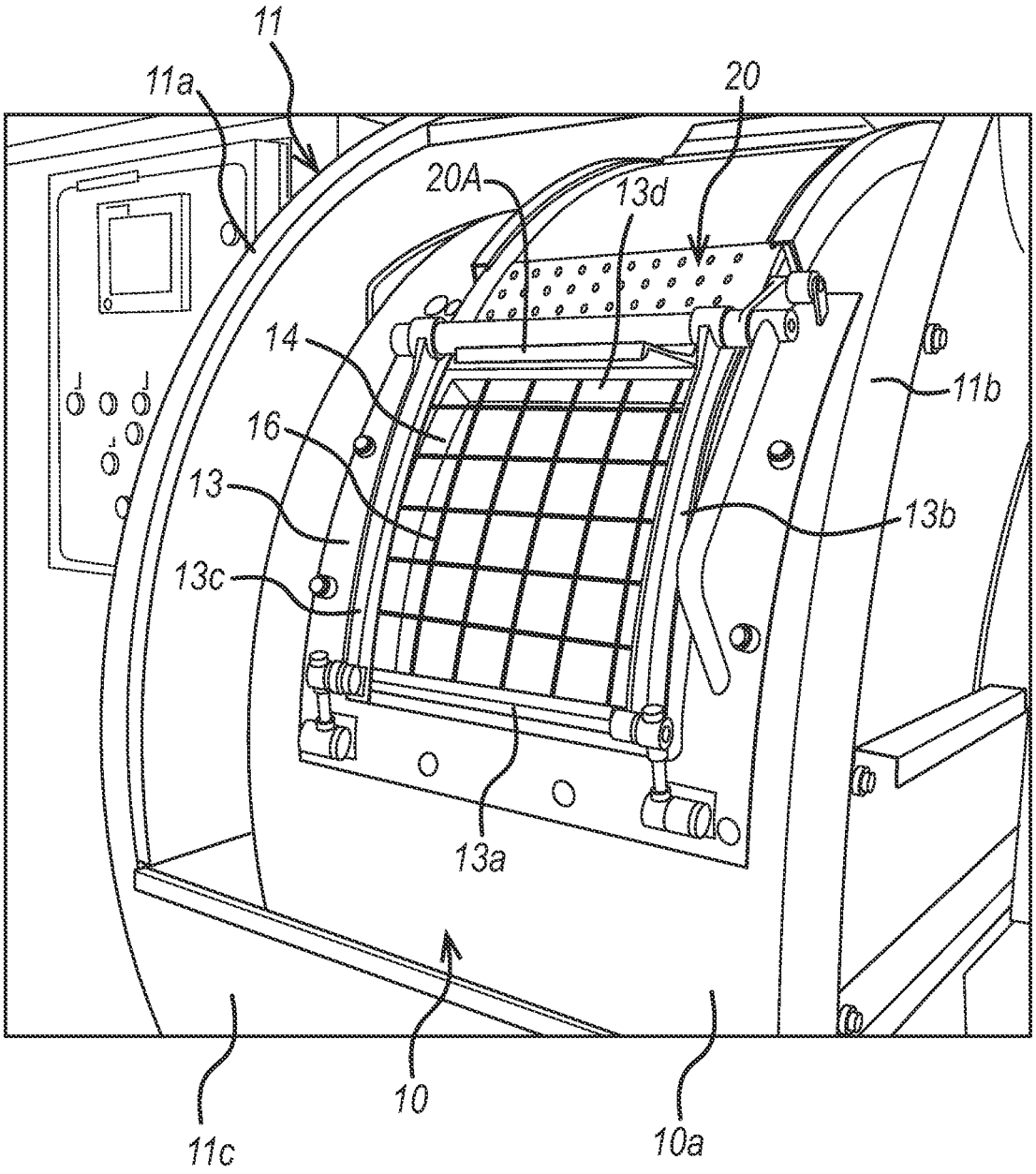
FIG. 2 is an image showing the drum and closure according to the invention.

The drum 10 is defined by a side wall 10*a* and opposed end walls which enclose the internal volume which can contain the animal substrates together with portions of the solid particulate material and treatment liquor. FIG. 2 illustrates a drum 10 having a cylindrical side wall 10*a*, however non-cylindrical drums with more than one side wall are also permissible.

The internal surface of the side wall 10*a* of the drum 10 can include constructions adapted or configured to encourage further agitation of the substrates during the treatment process. For example, the internal surface of the side wall 10*a* can comprise protrusions or formations that can contact the substrates as the drum 10 rotates. The drum 10 can comprise one or more pegs such as wooden or plastic dowels protruding from the internal surface of the side wall 10*a*. The protrusions can be in the form of planar shelves that run substantially parallel to the axis of rotation of the drum 10.

The apparatus 100 can further comprise one or more inlet ports to deliver various components used in the treatment process (such as the solid particulate material, treatment liquor, treatment agents and/or any further additives) into the interior of the drum 10. The apparatus 100 can comprise a plurality of inlet ports to deliver the respective components used in the treatment process into the interior of the drum 10. The apparatus 100 can thus comprise a first drum inlet port 18 to introduce solid particulate material. The solid particulate material may or may not also be delivered in combination with treatment liquor, treatment agents and/or any further additives from the same inlet. The apparatus 100 can comprise a second drum inlet port 19 for introducing treatment liquor into the interior of said drum 10. The one or more inlet ports can extend through a portion of the side wall 10*a*. Other inlet ports can be provided for the addition of other treatment agents or materials, including gaseous treatment agents if desired. A given inlet port can serve for the introduction of multiple treatment agents or materials.

The drum 10 can further comprise an outlet opening 14 which provides an outlet for solid particulate material and fluids contained within the drum 10. The outlet opening is, preferably, the same as the access means. The outlet opening 14 is preferably formed in a portion of the sidewall 10*a* of the drum 10. Particularly, the outlet opening 14 can extend in the region defined by a frame 13. Outlet opening 14 is bounded by the inside edges of the frame 13. A lower inside edge 13*a*, upper inside edge 13*d* and first and second side inside edges 13*c*, 13*b* respectively define the periphery of the outlet opening 14. Here, "lower" and "upper" are defined in relation to the position of the outlet opening 14 shown in FIG. 2. The cross-sectional area of the outlet opening 14 can be about 125 $cm^2$.

An apertured screen is provided which can extend in a use position across the whole area of the outlet opening 14. The apertured screen 16 can be a perforate or reticulate screen 16 which thus comprises a plurality of holes or apertures. Preferably, the apertured screen 16 is in the form of a mesh. The apertured screen 16 can conveniently be moveably clamped, locked or fixed to the frame 13. Optionally, the apertured screen 16 is removable from the frame 13. Optionally, the apertured screen 16 is hinged to the frame 13 or can be slidably moveable with respect to the frame. By movement of the apertured screen 16 away from its use position access to the interior of the drum 10, such as for loading and unloading of the animal skin substrate, can be provided. The apertures of the apertured screen are dimensioned such that (with the apertured screen in its use position) fluids (in particular treatment liquor) and the solid particulate material can pass through the apertures 16 and thus exit via the outlet opening 14 when the drum 10 is rotated to an appropriate orientation and the closure 20 as described below is open. However, the size of the apertures are such that the animal skin substrates cannot exit the drum 10 through the screen 16 regardless of the orientation of the drum 10.

The apertured screen 16 can comprise apertures wherein said apertures have a maximum dimension a maximum dimension of about 125 mm, 100 mm, 75 mm, 50 mm, 35 mm, 26 mm, 25 mm, 10 mm, 5 mm or about 2 mm. Said apertures can have a maximum dimension of from about 2 to 100 mm, from about 2 to 75 mm, from about 2 to 50 mm, from about 2 to about 35 mm, from about 2 to 26 mm, from about 2 to 25 mm or from about 2 to about 10 mm. The apertured screen 16 can comprise apertures having a maximum dimension of from about 2 to about 10 mm, in particular about 4 to about 10 mm, or said apertures can have a maximum dimension of from about 5 to about 8 mm or said apertures can have a maximum dimension from about 6 to about 10 mm. Optionally, the apertured screen 16 can comprise apertures having a maximum dimension of from about 26 mm to about 125 mm. Preferably, the apertured screen 16 comprises apertures having a maximum dimension of about 50 mm.

The apertured screen 16 comprises a material that is sufficiently strong to withstand or support the combined weight of animal skin substrates loaded into the interior of the drum 10. The drum 10 can contain animal skin substrates with a combined weight of anywhere between 50 kg and 50000 kg, depending, for example, on the size of the drum. In addition, the apertured screen 16 preferably comprises materials that exhibit at least some (and more preferably at least substantial) resistance to corrosion and particularly comprises materials that exhibit resistance to the corroding effects of any chemicals or additives present in the treatment liquor. Thus, the apertured screen 16 can comprise corrosion resistant metals, corrosion resistant metal alloys, plastics, fibrous, fibreglass, composites or polymeric materials. Other flexible/ductile materials can also be used. Furthermore, the apertured screen 16 may be coated or uncoated.

The apertured screen 16 may thus comprise metals and metal alloys including, but not limited to, steel, aluminium, brass, copper, titanium and tungsten. Preferably, the apertured screen 16 comprises stainless steel.

The apertured screen 16 may thus comprise composites including, but not limited to, carbon, boron or glass fibre filled polyester or polycarbonate.

The apertured screen 16 may thus comprise plastic materials including, but not limited to, polypropylene, polyethylene, polycarbonate, nylon, polyvinylchloride, high-density polyethylene or polytetrafluoroethylene.

The apertured screen 16 can comprise various combinations of the above-noted materials. For example, the apertured screen 16 can comprise plastic materials reinforced with a suitable metal or metal alloy.

Where apertured screen 16 is in the form of a mesh, suitable meshes include, but are not limited to, aramid, polycarbonate, polyester or polyacrylic polymer meshes.

Preferably, the solid particles employed in the invention have an average particle diameter of from 1 mm to 100 mm, or from 1 to 50 mm or 1 to 25 mm or 1 to 15 mm or 1 to 10 mm or from 2.0 to 8.0 mm, or the solid particles can have a diameter of from 4.0 to 7.0 mm or from 5.0 to 7.0 mm. Optionally, the solid particles have an average particle diameter of from 1.0 to 6.0 mm, or from 1.0 to 5.0 mm or from 2.5 to 4.5 mm. The effective average diameter can also be calculated from the average volume of a particle by simply assuming the particle is a sphere. The average is preferably a number average. The average is preferably performed on at least 10, more preferably at least 100 particles and especially at least 1000 particles.

The solid particles can have a length of from 1 mm to 100 mm, or from 1 to 50 mm or 1 to 25 mm, or from 1 to 15 mm or from 1 to 10 mm or from 2.0 to 8.0 mm or from 4.0 to 7.0 mm or from 5.0 to 7.0 mm, or the solid particles can have a length of from 1.0 to 6.0 mm or from 1.0 to 5.0 mm or from 2.5 to 4.5 mm. The length can be defined as the maximum 2 dimensional length of each 3 dimensional solid particle. The average is preferably a number average. The average is preferably performed on at least 10, more preferably at least 100 particles and especially at least 1000 particles.

The drum 10 further comprises a closure 20 operable to close the outlet opening 14. The closure 20 can be in the form of a door. The closure 20 can be mounted to a portion of the sidewall 10*a* of the drum 10 and is configured for movement between open and closed positions. Preferably, the closure 20 is mounted to an exterior portion of the sidewall 10*a*. When the closure 20 is moved to the closed position fluids and solid particulate material are prevented from exiting the drum 10 through the outlet opening 14. The closure 20 is thus sized and arranged such that when it is moved to the closed position, it completely covers the outlet opening 14. Advantageously a clamping arrangement or the like can be provided to urge the closure into sealing engagement with frame 13. A locking device or arrangement can be provided to retain the closure 20 in its closed position. Preferably, when the closure 20 is moved to the closed position, there exists no gap between an internal surface of the closure 20 and an exterior portion of the sidewall 10*a* (such as frame 13) through which fluids and/or solid particulate material can pass.

The closure 20 can be in the form of a door, in particular a solid door. The closure 20 can be hingedly mounted or slidably mounted to a portion of the sidewall 10*a* of the drum 10. Preferably, the closure 20 is slidably mounted to a portion of the sidewall 10*a*. In order to move the closure 20 between open and closed positions, a leading edge 20A can be slid towards the lower inside edge 13*a* of the frame 13. When the leading edge 20A is moved to a position that is coincident with or beyond the lower inside edge 13*a*, the outlet opening 14 from the drum 10 is closed. If the leading edge 20A is moved to a position that is coincident with or above the upper inside edge 13*d*, the outlet opening 14 from the drum 10 is fully open. A series of intermediate positions exist wherein the leading edge 20A can be moved to various points defined between the upper inside side edge 13*d* and the lower inside edge 13*a*. In these intermediate positions the outlet is partially open as only a portion of the outlet opening 14 is covered by the closure 20. For intermediate positions wherein the outlet is partially open, the periphery of the outlet opening 14 is bounded by the leading edge 20A of the closure 20 and the lower inside edge 13*a* plus first and second side inside edges 13*c*, 13*b* of the frame 13.

The apparatus 100 can further comprise a controller operable to move said closure 20 between open and closed positions. Preferably, the controller sends a signal to an actuator arranged on the drum 10 in response to which the actuator causes the closure 20 to move from a closed position to an open position or vice versa. Particularly, said controller is operable to move said closure 20 from a closed position to an open position after a predetermined period of operation of the apparatus 100. The predetermined period is specified by the type of treatment conducted or the phase in a treatment cycle reached in the treatment of the animal skin substrate(s). The controller can be an electronic controller wherein said electronic controller is configured to responsively send a signal to an actuator arranged on the drum 10 in response to which the actuator causes the closure 20 to move from a closed position to an open position after said predetermined period.

The controller can be operable to move said closure 20 from an open position to a closed position (optionally by intervention of the actuator) after a predetermined period. Thus, the controller can be an electronic controller wherein said electronic controller is configured to responsively send a signal to an actuator arranged on the drum 10 to cause the closure 20 to move from an open position to a closed position after said predetermined period.

The drum 10 can be of any size which is commonly found tanneries for the processing of animal hides and can typically have a capacity in the region of 500 to 40,000 litres. A typical size of a drum 10 to process animal hides in this range would generally comprise a cylinder with a diameter in the region of 0.1 to 10 m, preferably from 0.5 to 5 m, and a width of between 0.1 and 10 m, preferably between 0.5 and 5 m. Larger drum sizes are however permissible and can have a capacity of up to 200,000 litres. The drum can comprise a cylinder with a diameter of about 1.2 m and a width of about 0.6 m. Preferably the drum 10 has a capacity of greater 100 litres and more preferably greater than 1000 litres. Said drum 10 can have a capacity of from 500 to 200,000 litres, preferably of from 500 to 135,000 litres, more preferably from 500 to 75,000 litres and most preferably from 500 to 40,000 litres.

The internal volume of the drum 10 is sufficiently large so to accommodate a desired amount of the animal skin substrate(s) to be treated, together with the solid particulate material and treatment liquor, whilst still providing sufficient ullage to allow for efficient circulation and mixing of the materials when agitated during the treatment process. Typically, in selecting the drum size in relation to the desired load of animal skin substrate, solid particulate material and treatment liquor allowance should desirably be made for ullage values of at least 10% by volume, preferably at least 20% by volume, and most preferably from 30 to 70% or 30 to 60% by volume in order to provide for efficient mixing whilst maximising the utilisation capacity of the treatment process. Loading of the animal skin substrates, solid particles and treatment liquor (plus any additives) in the apparatus 100 can thus be carried out to accommodate the above-noted ullage values.

The apparatus 100 can further comprise a storage vessel 40 to retain the solid particulate material prior to delivery to the drum 10. The apparatus 100 can additionally include a dispenser 30 and a conduit 18A connected to the first drum inlet 18 for introducing solid particulate material to the drum 10. Solid particles from the storage vessel 40 can be transported to the dispenser 30 via conduit 32. The storage vessel 40 can further comprise one or more inlets or outlets which communicate with blowing and/or suction devices to facilitate the flow of solid particulate material to the conduit 32.

Furthermore, storage vessel 40 can include one or more valves or gates to control the entry of solid particulate material to conduit 32 thereby regulating the flow of solid particulate material prior to entry to the drum 10. Alternatively, or in addition, dispenser 30 can include one or more valves or gates to control the entry of solid particulate material to conduit 18A thereby regulating the flow of solid particulate material to the drum 10.

The one or more valves or gates of the storage vessel 40 and/or the dispenser 30 can further be used to segregate the solid particulate material. Segregated solid particulate material can then be cleaned, washed and rinsed in the storage vessel 40 and/or the dispenser 30. Preferably, the storage vessel 40 and/or the dispenser 30 additionally comprises one or more inlets for the introduction of cleaning agents to clean the solid particulate material. Furthermore, said storage vessel 40 and/or said dispenser 30 can comprise one or more inlets to introduce gaseous cleaning agents for cleaning the solid particulate material.

Rotation of the drum 10 with the closure 20 in an open position (such as a "fully open" or any "partially open" position) and the apertured screen in its use position causes solid particulate material and treatment liquor to exit the drum 10 through the outlet in the sidewall 10*a*. The solid particulate material and treatment liquor exit the drum 10 under the influence of gravity. Consequently, the egress of solid particulate material and treatment liquor is dependent, at least in part, on the rotational arrangement of the drum 10, the amount of animal skin substrate, treatment liquor and solid particulate material contained from time to time in the drum and on the position of the outlet relative to the floor. Typically, when the drum 10 has rotated such that the outlet is facing substantially downwardly (i.e. when the outlet opening 14 has rotated to a position below the rotational axis of the drum and which includes a vertical plane through the rotational axis of the drum), the egress of solid particulate and treatment liquor out of the drum 10 and through the outlet is maximized. By contrast, when the drum 10 has rotated such that the outlet is facing substantially upwardly (i.e. when the outlet opening is above the axis of rotation of the drum) there will be limited or no egress of solid particulate and treatment liquor through the outlet opening 14. Some egress of solid particulate and treatment liquor through the outlet opening 14 is permissible at intermediate rotational arrangements. However the extent to which this occurs will depend on the quantity of materials within the drum 10. By means of example, egress of solid particulate and treatment liquor through the outlet can occur at a rotational arrangement considerably earlier than substantially downward position mentioned above when the fluid level in the drum 10 is relatively higher.

The treatment apparatus 100 can further comprise an external housing, casing or outer jacket 11 surrounding at least a portion of the drum 10 and within which the drum can rotate about its axis. The outer jacket 11 can comprise first and second side walls 11*a*, 11*b*, a lower front wall 11*c*, a top wall 11*d* and a rear wall 11*e*. The outer jacket 11 can have a length dimension greater than the diameter of the drum 10 and a width dimension that is also greater than the drum 10. Thus the distance between the lower front wall 11*c* and rear wall 11*e* is greater than the diameter of the drum 10 and, as illustrated in FIG. 2, the distance between the first and second side walls 11*a*, 11*b* of the outer jacket is greater than the width of the drum 10*w*. Furthermore, the walls of the outer jacket 11 are spaced apart from the external walls of the drum 10. The configuration of the outer jacket 11 enables treatment liquor and solid particulate material exiting from the outlet to be intercepted by the internal surfaces of the walls of the outer jacket 11 as the drum 10 rotates.

The treatment apparatus 100 can further comprise a collecting region 50 for solid particulate material and treatment liquor leaving the drum 10 via the outlet. Preferably, the collecting region 50 can comprise a collection vessel 52 disposed immediately below the drum 10. The collection vessel 52 can comprise an upper portion having a mouth 52A and is suitably aligned with the drum 10 such that at least when the outlet opening 14 is in a downwardly directed position, solid particulate material and treatment liquor fall out of the outlet of the drum 10 and through the mouth 52A into the collection vessel 52. In some embodiments the collection vessel 52 can act as a funnel and comprises sloping side walls 52*a*. The sloping side walls 52*a* can be so inclined as to direct the solid particulate material and treatment liquor to a lowermost part 52B of the collection vessel 52. Particularly, the sloping side walls 52*a* can be inclined at an angle of from about 1° to about 89°, from about 1° to about 75° or from about 25° to about 65° with respect to the vertical. Preferably, the sloping side walls 52*a* are inclined at angle of about 45° with respect to the vertical.

The collection vessel 52 can be unitary with the outer jacket 11. In these embodiments, the sloping side walls 52*a* of the collection vessel 52 can extend from the walls of the outer jacket 11. Such a construction can thus encourage any treatment liquor and/or solid particulate material intercepted by the internal surfaces of the walls of the outer jacket 11 to flow into the collection vessel 52.

The apparatus 100 can additionally comprise a conduit, conveyor or the like 60 to transport solid particulate material and treatment liquor received in the collection vessel 52. Preferably, the conduit 60 is a flexible screw conveyor. The solid particulate material and treatment liquor can enter the conduit 60 from an inlet 60A located proximate a lowermost part of the collection vessel 52 and can be conveyed upwardly to an outlet 60B. In the case of a conduit 60, a suitable pump can be provided to convey the solid particulate material and treatment liquor through the conduit. After leaving the outlet 60B, the solid particulate material and treatment liquor recovered from the drum 10 can enter the storage vessel 40 via conduit 42.

The collecting region 50 and/or the collection vessel 52 can further comprise one or more inlets or outlets which communicate with blowing and/or suction devices to facilitate the flow of solid particulate material to conduit 60.

The collecting region 50, and in particular the collection vessel 52, can comprise one or more valves or gates to control the entry of solid particulate material to conduit 60 thereby regulating the flow of solid particulate material prior to entry to storage vessel 40. The one or more valves or gates can additionally be used to segregate the solid particulate material. The segregated solid particulate material can then be cleaned, washed and rinsed. The collecting region 50, and in particular collection vessel 52, can further comprise one or more inlets for the introduction of cleaning agents to clean the solid particulate material in the collection vessel 52. Furthermore the collecting region 50, and particularly the collection vessel 52, can comprise one or more inlets to introduce gaseous cleaning agents for cleaning the solid particulate material.

The collection vessel 52 can comprise a load cell, weigh balance or other weighing means. The inclusion of such features can enable the mass of any fluids and/or solid particulate matter transferred to the collection vessel 52 to be calculated.

The storage vessel 40 can usefully comprise a separator 44 including one or more filters effective to separate treatment liquor from the solid particulate material. Once treatment liquor has been separated from the solid particulate material, the liquor can be collected in a lower portion of the storage vessel 40. A valve 70 in communication with a lower portion of the storage vessel permits either recirculation of the treatment liquor back into the drum 10 or its drainage for post-treatment processing and/or disposal. The valve 70 can be in the form of a 3-way valve. If the treatment liquor is to be recirculated, it can be directed along conduit 72 for re-introduction to the drum 10. Thus, conduit 72 can communicate with dispenser 30 which is in turn connected to conduit 18A and drum inlet 18. In an alternative embodiment, the conduit 72 can instead communicate with second drum inlet 19 in order to re-introduce treatment liquor back into the drum 10. In the event that the treatment liquor is not to be re-used in the treatment process, it can be sent to waste collector 80 via drainage conduit 74.

Following removal of residual treatment liquor in the storage vessel 40 by the separator 44, the solid particulate material can also be transported along conduit 32 to the dispenser 30 for re-introduction to the drum 10 via conduit 18A and first drum inlet 18. Solid particulate material can be circulated and re-used in a single treatment process carried out by the apparatus 100. The circulation path for the solid particulate material via the conveyor 60 can thus be illustrated by the arrows labeled "A" in FIG. 1.

Furthermore, the apparatus 100 can comprise a device for removing residual treatment liquor and deposits generated as a result of the treatment process from said solid particles. The deposits can include any matter derived from the animal skin substrates. Typically, the device can carry out one or more washing or rinsing stages. The device can be located within the apparatus 100 in a portion of the circulation path between the outlet 60B of the conveyor and the inlet 18 of the drum 10.

The treatment process utilizing the method of the present invention can consist of a "treatment cycle". As used herein, the term "treatment cycle" can refer to the total duration necessary to complete the desired treatment of the animal skin substrate and may comprise one or more phases or stages. For example, a first portion of the treatment liquor which may comprise water can be added to the animal skin substrate before the addition of the solid particulate material. The animal skin substrate can be agitated with the treatment liquor alone in the drum of the apparatus prior to agitation with the treatment liquor in combination with the solid particulate material as a first phase of the treatment process. A second portion of the treatment liquor which can comprise one or more treatment agents and/or further additives can be added at a different time point in the treatment cycle. A series of treatment phases or stages can thus be conducted over the duration of the treatment cycle wherein the treatment liquor can be kept constant or varied for each respective phase.

The solid particulate material can be retained throughout the treatment cycle as portions of the treatment liquor are added as outlined above. In other embodiments, the solid particulate material can be replaced prior to the addition of a further portion of the treatment liquor. This can be necessary to ensure that the animal skin substrate is not adversely affected by interactions occurring between incompatible chemical moieties. For example, chemical moieties which could potentially adhere to the solid particulate material following the introduction of one portion of the treatment liquor may not be compatible with chemical moieties present in a subsequent portion of the treatment liquor thus necessitating replacement of the solid particulate material before continuing the treatment cycle.

Each phase of the treatment cycle can comprise one or more agitation steps wherein the animal substrates are agitated with the solid particulate material and treatment liquor. After a given agitation step, the solid particulate material can leave the drum via the outlet and can then be transferred along a circulation path via the conveyor to re-enter the drum in the manner described above. In this way, a further or subsequent agitation step can be carried out with the same solid particulate material.

Preferably, the duration of the treatment cycle is a period of from about 1 minute to about 100 hours and preferably the duration of the treatment cycle is from about 1 minute to about 48 hours. Where the treatment cycle comprises more than one phase, each respective phase of the treatment cycle can be any period of 30 seconds or greater or 1 minute or greater wherein the sum of the respective phases comprises the total duration of the treatment cycle. Each respective phase of the treatment cycle can be a period of from 30 seconds to 10 hours.

Preferably, the animal skin substrate(s) is agitated with the solid particulate material and treatment liquor in the drum 10 for a first time period with the outlet opening 14 closed. Preferably, said first time period is at least 30 seconds, at least 1 minute, at least 5 minutes, at least 15 minutes, at least 30 minutes, at least 1 hour, at least 5 hours, at least 12 hours, at least 24 hours or at least 48 hours.

Preferably, following agitation of the animal skin substrate(s) with the solid particulate material and treatment liquor in the drum 10 for said first time period, the drum is rotated for a second time period with the outlet opening 14 open (i.e. fully open or partially open). Preferably, said second time period is at least 30 seconds, at least 1 minute, at least 5 minutes, at least 10 minutes, at least 15 minutes, at least 20 minutes, at least 25 minutes, at least 30 minutes, at least 45 minutes, at least 1 hour, at least 1 hour 30 mins, at least 2 hours, at least 4 hours, at least 5 hours or at least 12 hours.

The apparatus and method of the invention facilitates a considerable reduction in the duration of a typical treatment cycle as the presence of the solid particulate material can enhance the effect or degree of mechanical action performed on the animal substrate. Furthermore, as the apparatus and method of the invention enables a reduction in the quantity of water or liquor needed in the drum, the effective concentration of chemicals dissolved in the treatment liquor is increased thereby resulting in faster mass transfer to the animal skin substrate(s) leading to a reduction in the duration of the treatment cycle time. Thus the duration of each phase of the process can be reduced leading to a typical reduction of 20 to 50% of the total duration of the treatment cycle when compared to the methods employed in the prior art.

Optionally, the mechanical action performed on the animal skin substrate by virtue of agitation with the solid particulate material is never sufficient to break up the animal substrate. Preferably, the solid particulate material does not penetrate the surface of the animal substrate, for example as a consequence of the particle size of the solid particulate material.

The solid particulate material of the invention can be re-used one or more times for treatment of the animal substrates in a single treatment cycle or in subsequent treatment cycles. In this context, a single "use" of the solid particulate material equates to a single agitation step as performed in the drum with the animal skin substrates. Preferably, the solid particulate material is re-used at least two, three, four, five or more times, such as 10, 20, 50 or 100 or more times. The solid particulate material is typically not reused more than 10,000 or more than 1,000 times.

The solid particulate material can be subject to a cleaning operation. Intermittent cleaning of the solid particulate material is often desirable when the solid particulate material is re-used. Preferably, the cleaning of the solid particulate material is conducted within the apparatus 100. A cleaning operation can be conducted in the collecting region 50, collection vessel 52 and/or in the storage vessel 40. Alternatively, the cleaning of said solid particulate material can be carried out within the drum 10. Cleaning can be helpful in preventing unwanted contaminants from building up and/or in preventing treatment components from degrading and then depositing on the animal substrate. The particle cleaning step can typically be performed after every 10, after every 5, after every 3, after every 2 or after every 1 agitation step(s). The cleaning step can comprise washing the solid particulate material with a cleaning formulation. The cleaning formulation can be a liquid medium such as water, an organic solvent or a mixture thereof. Preferably, the cleaning formulation comprises at least 1 wt %, preferably 10 wt %, more preferably at least 30 wt %, even more preferably at least 50 wt %, especially at least 80 wt % water, more especially at least 90 wt % water. The cleaning formulation can comprise one or more cleaning agents to aid the removal of any contaminants. Suitable cleaning agents can include surfactants, detergents, bleaching agents (e.g. sodium hypochlorite), oxidizing agents (e.g. hydrogen peroxide), dye transfer agents, biocides, fungicides, builders, acids, bases (e.g. sodium hydroxide and ammonium hydroxide), reducing agents and metal chelating agents. Gaseous cleaning agents can be used such as ammonia and ozone. The solid particulate material can be cleaned at a temperature of from 0 to 40° C. for energy economy but for even better cleaning performance temperatures of from 41 to 100° C. can be used. The cleaning times can generally be from 1 second to 10 hours, typically from 10 seconds to 1 hour and more typically from 30 seconds to 30 minutes. The cleaning formulation can be acidic, neutral or basic depending on the pH which best provides for cleaning of the specific components circulated from the drum 10.

The apparatus 100 of the invention therefore enables cleaning of the solid particulate material in various alternative locations. Cleaning operations can thus be conducted in any one or more of the collecting region 52, collection vessel 50 and the storage vessel 40 using the above-noted cleaning agents. Advantageously, the solid particulate material can be subjected to more than one cleaning operation in different positions within the apparatus 100 prior to re-use in a subsequent agitation step.

As noted above, the solid particulate material can be subjected to a cleaning operation within the drum 10. In such embodiments, after an agitation step with treatment liquor and solid particles has been completed, the treatment liquor can first be drained from the drum 10 and then cleaning formulation introduced to the drum 10. The cleaning formulation can comprise water and/or any of the cleaning agents described above. Following the introduction of the cleaning formulation, the solid particles can be agitated within the drum. After the cleaning operation has been completed, the solid particles can be re-used for additional agitation and/or treatment steps.

Alternatively, the solid particulate material can be removed from the apparatus 100 and cleaned before its re-use in an additional phase of the treatment process. In further embodiments, the solid particulate material can be replaced before commencing an additional phase in the treatment process.

The apparatus 100 can include means to facilitate the easy removal of the solid particulate material after the end of a phase in the treatment process or after completion of the treatment process. The apparatus 100, and preferably the drum 10, can thus include a vacuum, a blower, a magnet or other appropriate apparatus to facilitate solid particle removal.

The solid particulate material employed in the apparatus and process of the invention can comprise a multiplicity of polymeric or non-polymeric particles. Most preferably, the solid particulate material can comprise a multiplicity of polymeric particles. Alternatively, the solid particulate material can comprise a mixture of polymeric particles and non-polymeric particles. Alternatively, the solid particulate material can comprise a multiplicity of non-polymeric particles. Thus the solid particulate material in the invention can comprise exclusively polymeric particles, exclusively non-polymeric particles or mixtures of polymeric and non-polymeric particles in any desired relative amounts. Throughout this disclosure wherever a ratio is quoted with respect to polymeric and/or non-polymeric particles this will be understood as a reference to the sum total of polymeric and/or non-polymeric particles that may constitute the solid particulate material.

The polymeric or non-polymeric particles are of such a shape and size as to allow for good flowability and intimate contact with the animal skin substrate. A variety of shapes of particles can be used, such as cylindrical, spherical, ellipsoidal, spheroidal or cuboid; appropriate cross-sectional shapes can be employed including, for example, annular ring, dog-bone and circular. Ellipsoidal, spheroidal or spherical solid particles are particularly preferred. The particles can have smooth or irregular surface structures and can be of solid, porous or hollow construction. Non-polymeric particles comprising naturally occurring materials such as stone may have various shapes, dependent on their propensity to cleave in a variety of different ways during manufacture. Most preferably, however, said particles can comprise cylindrical, ellipsoidal, spheroidal or spherical beads.

The multiplicity of solid particles employed in the invention are preferably of such a size as to have an average mass in the region of 1 mg to 500 g, more preferably from 1 mg to 100 g, more preferably from 1 mg to 1 g and most preferably 5 mg to 100 mg.

The multiplicity of solid particles of the invention can be chemically modified to include additional moieties. Thus, the particles can be chemically modified to further include one or more moieties selected from the group consisting of: enzymes, oxidizing agents, catalysts, metals, reducing agents, chemical cross-linking agents and biocides.

The polymeric particles can comprise polyalkenes such as polyethylene and polypropylene, polyamides, polyesters, polysiloxanes or polyurethanes. Furthermore, said polymers can be linear, branched or crosslinked. Said polymeric particles can comprise polyamide or polyester particles, particularly particles of nylon, polyethylene terephthalate or polybutylene terephthalate, typically in the form of beads. Copolymers of the above-polymeric materials can also be employed for the purposes of the invention. The properties of the polymeric materials can be tailored to specific requirements by the inclusion of monomeric units which confer particular properties on the copolymer. Various nylon homo- or co-polymers can be used including, but not limited to, Nylon 6 and Nylon 6,6. The nylon can comprise Nylon 6,6 copolymer, preferably having a molecular weight in the region of from 5000 to 30000 Daltons, more preferably from 10000 to 20000 Daltons, most preferably from 15000 to 16000 Daltons. The polyester can typically have a molecular weight corresponding to an intrinsic viscosity measurement in the range of from 0.3 to 1.5 dl/g, as measured by a solution technique such as ASTM D-4603. Said polymeric particles can comprise synthetic or natural rubber.

The polymeric particles can have an average density of about 0.5 g/cm$^3$ to about 3.5 g/cm$^3$. Polymeric particles having an average density of 0.5 to 2.5 g/cm$^3$ can be particularly suitable. Alternatively, polymeric particles having an average density of 0.5 to less than 1 g/cm$^3$ can be particularly suitable.

The polymeric or non-polymeric particles can be solid, porous or hollow.

The solid particulate material can comprise non-polymeric particles. In such embodiments, the non-polymeric particles can comprise ceramic material, refractory material, igneous, sedimentary or metamorphic minerals, composites, metal, glass or wood. Suitable metals include, but are not limited to, zinc, titanium, chromium, manganese, iron, cobalt, nickel, copper, tungsten, aluminium, tin and alloys thereof (such as steel). Suitable ceramics can include, but are not limited to, alumina, zirconia, tungsten carbide, silicon carbide and silicon nitride.

The non-polymeric particles may have an average density of 0.5 to 20 g/cm$^3$, more preferably from 2 to 20 g/cm$^3$, especially from 4 to 15 g/cm$^3$ and most especially from 4 to 10 g/cm$^3$.

In order to provide lubrication for the treatment system, the or each animal skin substrate can be moistened. This can be achieved by wetting the substrates with water by contact with mains or tap water for example. Wetting of the substrates within the apparatus of the invention is however preferable. The wetting of the substrates can be carried out so as to achieve a water to animal skin substrate ratio of between 1000:1 and 1:1000 w/w. Typically, the ratio of water to animal skin substrate can be from 1:100 to 1:1 w/w more typically from 1:50 to 1:2 w/w, especially typically from 1:40 to 1:2 w/w, more especially typically from 1:20 to 1:3 w/w and most typically from 1:15 to 1:5 w/w. Optionally, the ratio of water to animal skin substrate is at least 1:40 w/w, at least 1:30 w/w, at least 1:20 w/w or at least 1:15 w/w. Optionally, the ratio of water to animal skin substrate is no more than 10:1 w/w, no more than 5:1 w/w, no more than 2:1 w/w or no more than 1:1 w/w.

It may be desirable that no further water is added to the animal skin substrate other than that present in the animal skin substrate(s) as a result of prior treatment methods. Thus, the treatment liquor can be formed by adding a "neat" treatment agent or combination of "neat" treatment agents to the treatment volume 14 of the drum 10. In this context "neat" preferably means only the active or efficacious component of the treatment agent is added and is thus introduced to the treatment volume without further liquid diluents such as water, organic liquids and the like. The treatment agent can be added to the treatment volume in the form of a dry powder or alternatively as a liquid containing only the active component. The liquid (especially water) already present in the pre-wetted or pre-moistened animal skin substrate is therefore sufficient to form the treatment liquor "in situ" within the drum. Advantageously, this approach can ensure the amount of liquid or water used is the treatment process is even lower. Also, it has been found that this approach can lead to a further improvement in the treatment in terms of uniformity, depth of penetration and in terms of the percentage of treatment agents which are incorporated into the animal skin substrate. In this way the resulting animal skin substrate after treatment is of a better quality (having improved chemical, physical or aesthetic properties) and the amounts of treatment agents remaining in the liquor after the treatment method is complete are even further reduced.

The weight ratio of animal skin substrate(s):solid particulate material is preferably from 10:1 to 1:10, more preferably from 5:1 to 1:5, preferably from 3:1 to 1:3, preferably from 2:1 to 1:2, most preferably 1.5:1 to 1:1.5. Preferably, the weight ratio of animal skin substrate(s):solid particulate material is about 1:1.5. Preferably, the weight of the animal skin substrate for this ratio is based on the wet weight of the animal skin substrate. The wet weight of the animal skin substrate used herein preferably refers to any latent fluid (typically water) present within the animal skin substrate itself.

Preferably, throughout this invention the dry weight of a wet substrate is from 25 to 75 wt % of the wet weight, typically about 50 wt %. So for example, 2 Kgs of wet animal skin substrate comprises 1 Kg of dry animal substrate.

The weight ratio of the animal skin substrate(s):fluid (especially water) is preferably from about 1:5 to about 100:1, typically from about 1:2, typically from about 1:1, and typically from about 2:1, typically from about 3:1 and typically from about 5:1, typically no more than about 40:1, typically no more than about 30:1, typically no more than about 20:1, and typically no more than about 15:1. Preferably the weight of the animal skin substrate is based on the wet weight of the animal skin substrate.

The weight ratio of the dry animal skin substrate:fluid is preferably from 10:1 to 1:10, more preferably 7:1 to 1:7, even more preferably 4:1 to 1:4, yet more preferably 3:1 to 1:3 and most preferably 2:1 to 1:2 by weight.

Preferably, the ratio of the treatment volume of the drum (in $m^3$):to the weight of fluid in the drum (in metric tonnes) is from about 1:100 to about 100:1.

Preferably, the ratio of the treatment volume of the drum (in $m^3$):to the weight of fluid in the drum (in metric tonnes) is in order of increasing preference at least 1:4, 1:3, 1:2, 1:1, 2:1, 3:1, 4:1, 5:1, 10:1, 20:1, 25:1, 30:1, 35:1, 40:1, 45:1, 50:1, 60:1 and 70:1.

The ratio of the treatment volume of the drum (in $m^3$):to the weight of fluid in the drum (in metric tonnes) is preferably, in order of increasing preference, no more than about 75:1, no more than 60:1, no more than 50:1, no more than 40:1, no more than 30:1, no more than 25:1, no more than 20:1 and no more than 15:1.

The treatment liquor employed by the present invention comprises a liquid medium and preferably comprises water or water when combined with at least one treatment agent and/or any further additives as detailed hereinbelow. The composition of the treatment liquor may depend at any given time on the point which has been reached in the treatment process. Thus, for example, at the start of the treatment process, the treatment liquor may be water. At a later point in the treatment process the treatment liquor may include one or more treatment agents and/or one or more further additives. Alternatively, one or more treatment agents and/or one or more further additives may be added in combination with water at the start of the treatment process. During the treatment process, the treatment liquor may also include suspended soil and/or particulate deposits removed from the animal substrate.

The treatment liquor can be aqueous. The treatment liquor can comprise at least 0.1% w/w water or at least 1% w/w water or at least 5% w/w water, or between 5% and 99.9% w/w water. The treatment liquor can comprise not more than 99.9% w/w water.

Treatment liquor can comprise water alone or it can comprise water and one or more organic solvents. The organic solvents may be water-miscible. Preferred organic solvents can be alcohols, glycols and amides. The treatment liquor can comprise at least 10 wt %, more preferably at least 50 wt %, especially at least 80 wt %, more especially at least 90 wt % and most especially at least 95 wt % of water. The treatment liquor comprises preferably less than 10 wt %, more preferably less than 10 wt % organic solvents. Optionally, no organic solvents are present in the treatment liquor other than trace amounts from impurities in other components of the treatment liquor.

Alternatively, the treatment liquor is substantially free from water except for any latent fluid (typically water) present within the animal skin substrate itself. Thus, water can be carried into the drum originating from the animal skin substrate. Alternatively, the treatment liquor is substantially free from water.

The treatment process performed on the animal skin substrate can comprise a cleaning step. The cleaning step can be performed prior to a chemical modification of the substrate. Cleaning may be necessary to remove any unwanted materials adhered to the exterior of the animal substrate. The treatment liquor used in the cleaning step can comprise one or more enzymes. The treatment liquor can comprise proteolysis enzymes. In order to enhance cleaning of the animal skin substrate, in particular in a cleaning step, the treatment liquor can comprise one or more surfactants. Preferably, the treatment liquor comprises non-ionic surfactants.

The treatment process can comprise one or more additional steps to remove further unwanted materials from the animal substrate. For example, the animal skin substrate can be subject to liming and deliming. In such embodiments, the treatment liquor, at least for such additional steps, can comprise reducing agents, bases, acids and/or neutralizing agents.

The treatment liquor of the invention can comprise one or more components effective to modify the animal skin substrate in some way and optionally impart certain properties to the modified substrate. Thus the treatment liquor can contain ingredients which perform a cleaning function and ingredients that elicit other effects such as chemical modification of the substrate. The treatment liquor of the invention can comprise one or more components selected from the group consisting of: solvents, surfactants, cross-linking agents, metal complexes, corrosion inhibitors, complexing agents, biocides, builders, catalysts, chelating agents, dispersants, perfumes, optical brightening agents, enzymes, dyes, pigments, oils, waxes, waterproofing agents, flame retardants, stain repellants, reducing agents, acids, bases, neutralizing agents, polymers, resins, oxidising agents and bleaches.

Suitable surfactants for use in the treatment liquor can be selected from non-ionic and/or anionic and/or cationic surfactants and/or ampholytic and/or zwitterionic and/or semi-polar nonionic surfactants.

Suitable builders can be included in the treatment liquor and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid and soluble salts thereof.

Optionally, the treatment liquor can also contain dispersants. Suitable water-soluble organic materials are the homo- or co-polymeric acids or their salts, in which the polycarboxylic acid may comprise at least two carboxyl radicals separated from each other by not more than two carbon atoms.

Optionally, the treatment liquor can also contain perfumes. Suitable perfumes can generally be multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl) cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

The treatment liquor can include an optical brightening agent. Suitable optical brighteners which can be included in the treatment liquor fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds can include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino] stilbene-2,2'-disulphonic acid, disodium salt, 4,4'-Bis[[2-anilino-4-[bis(2-hydroxyethyl)amino]-1,3,5-triazin-6-yl] amino]stilbene-2,2'-disulphonic acid, disodium salt, 4,4'-bis [(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

The treatment process of the invention can comprise a step wherein the animal skin substrate is agitated with a treatment liquor comprising one or more oils. The inclusion of one or more oils in the treatment liquor can impart specific properties to the substrate. The treatment liquor can comprise oils with at least one sulphur moiety such as sulphated and/or sulphited oils to provide softness and flexibility to the animal substrate. Oils can be included to provide anti-static control, reduce friction and/or to improve lubrication.

Suitable acids which can be contained in the treatment liquor include, but are not limited to, sulphuric acid, formic acid. Ammonium salts (e.g. ammonium sulphate and ammonium chloride) can be included in the treatment liquor. Suitable bases can include, but are not limited to, calcium hydroxide and sodium hydroxide. Suitable neutralizing agents include, but are not limited to, sodium carbonate and sodium bicarbonate.

Enzymes that can be used in the treatment liquor can include, but are not limited to, hemicellulases, peroxidases, proteases, carbonic anhydrases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases and mixtures thereof.

Dyes that may be used in the treatment liquor can include, but are not limited to, anionic, cationic, acidic, basic, amphoteric, reactive, direct, chrome-mordant, pre-metallised and sulphur dyes.

The treatment liquor can include one or more bleaches and/or oxidizing agents. Examples of such bleaches and/or oxidizing agents can include, but are not limited to, ozone, peroxygen compounds, including hydrogen peroxide, sodium hypochlorite, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. The bleaches and/or oxidizing agents can be activated by a chemical activation agent. Activating agents can include, but are not limited to, carboxylic acid esters such as tetraacetylethylenediamine and sodium nonanoyloxybenzene sulphonate. Alternatively, the bleach compounds and/or oxidizing agents can be activated by heating the formulation.

Preferably, the treatment process of the invention includes one or more chemical modification steps in order to colour the substrate. Thus, the treatment liquor can include at least one colourant. The colourant can be selected from, for example, one or more dyes, pigments, optical brighteners or mixtures thereof.

The colourant can be one or more dyes selected from anionic, cationic, acidic, basic, amphoteric, reactive, direct, chrome-mordant, pre-metallised and sulphur dyes.

The solid particulate material can be substantially uncoated with one, several or all components of the treatment liquor (excluding of course water). In particular, prior to at least a first agitation step it is preferred that the solid particulate material is not coated with a colourant (e.g. a dye or a pigment). The treatment liquor and the solid particulate material can be premixed prior to the agitation step but this is preferably under conditions which do not promote or cause the colourant to coat the particles of the solid particulate material. So for example, the colourant can be a dye which is soluble in the treatment liquor, e.g. having a solubility of greater than 1 g per litre, more preferably greater than 2 g per litre and especially greater than 5 g per litre of the treatment liquor, and/or additional organic solvents can be added to the water in the treatment liquor to promote solubility of the dye, and/or the solid particulate material can be chosen which specifically has no affinity with the dye. Suitable organic solvents can include water-miscible alcohols, glycols, amides and the like. When the colourant is insoluble or only partially soluble in the treatment liquor it is preferred that the colourant is dispersed with one or more dispersants. These can be cationic, anionic or non-ionic dispersants. Coating of the solid particulate material may be prevented or inhibited by having dispersants of the same type which stabilize both the solid particulate material and the colourant during the agitation step. For example both the colourant and the solid particulate material can be dispersed with an anionic dispersant, both can be dispersed with a cationic dispersant or both can be dispersed with a non-ionic dispersant. When dispersing the colourant it is preferably a pigment, an insoluble dye or a slightly soluble dye (<1 g litre) dye. When the colourant is dispersed or dissolved in the treatment liquor in the presence of the particulate solid this is preferably done below 30° C., more preferably below 25° C. Using lower temperatures tends to reduce the possibility for coating the solid particulate material.

The colourant can be dispersed or dissolved in the treatment liquor. The colourant can be dispersed or dissolved in the treatment liquor in the absence of the solid particulate material. This can help to prevent any possibility that the colourant pre-coats the solid particulate material. The solid particulate material can then be added prior to or during agitation. Alternatively, the colourant can be dispersed or dissolved in an aqueous liquid medium (again in the absence of the solid particulate material) and then added to the treatment liquor.

A mixture of the treatment liquor containing a colourant and the solid particulate material can be such that substantially no coating of the solid particulate material results and the colourant does not penetrate into the solid particulate material. This can be determined by: i. adding 100 g of solid particulate material to 100 g of water containing 2 wt % of colourant; ii. stirring the mixture for 1 hour at 25° C.; iii. removing the solid particulate material from the water by means of filtration; iv. measuring the amount of colourant remaining in the water (e.g. by colourimetic, UV, refractive index or gravimetric analysis); and v. calculating the amount of colourant which has not coated or penetrated the solid particulate material. Preferably, this value should mean that greater than 90 wt %, more preferably greater than 95 wt %, especially greater than 98 wt % and more especially greater than 99 wt % of the colourant remains in the water. Preferably, the water is at pH 7.

The treatment liquor can comprise a colourant and the treatment process can comprise applying the colourant to the animal skin substrate wherein at least some of the colourant so applied originates from the treatment liquor. Typically, at least some, more typically essentially all of the colourant so applied was, prior to application, physically separate from the solid particulate material. Preferably, at least 50 wt %, more preferably at least 70 wt %, especially at least 90 wt %, more especially at least 99 wt % and most especially essentially all the colourant which is applied to the animal skin substrate originates from the treatment liquor (and not from the surface or interior of the solid particulate material). Preferably, during the method which comprises applying a colourant to the animal skin substrate there is no measurable net loss of colourant from the solid particulate material. This shows that essentially all of the colour applied to the animal skin substrate originates from the treatment liquor. Typically, the amount of colourant in or coating the particulate solid will remain constant or may just slightly rise during the agitation process.

The treatment liquor can have a basic (>7), an acidic (<7) or neutral (7) pH. It can be desirable that the pH of the treatment liquor in certain treatment steps or stages is acidic. The acidic pH is typically less than 6.9, more typically less than 6.5, even more typically less than 6 and most typically less than 5.5. The acidic pH is typically no less than 1, more typically no less than 2 and most typically no less than 3. The pH or the treatment liquor can differ at different times, points or stages in the treatment process according to the invention. Preferably, the treatment liquor has the above typical pH value for at least some time during the agitation.

Before or after said agitating the animal skin substrate with a treatment liquor and a solid particulate material, the methods of the present invention can include any one or more of the following steps used in the production of leather including: curing, fat liquoring, scudding, preserving, fleshing, splitting, soaking, liming, deliming, reliming, unhairing, bating, degreasing, frizzing, bleaching, pickling, depickling, pretanning, tanning, retanning, tawing, crusting, coating and dyeing and finishing.

Preferably, said treatment process is a tannery process and said treatment liquor comprises at least one treatment agent selected from tanning agents, re-tanning agents and tannery process agents.

The apparatus and method of the invention can facilitate a considerably higher level of incorporation of treatment agents such as tanning agents into the animal skin substrate thereby reducing the amount of chemicals wasted to effluent. The reduction of chemicals lost to effluent may be 10-50% w/w of the chemicals typically used in the methods employed in the prior art.

Preferably, said tannery process is selected from one or more of cleaning, curing, beamhouse treatments, tanning, re-tanning, fat liquoring, enzyme treatment, dyeing and dye fixing.

Preferably, the treatment process of the invention is a process used in the production of leather and can include one or more of: curing, beamhouse treatments, fat liquoring, pretanning, tanning, retanning, tawing, crusting and dyeing.

As used herein beamhouse treatments can include soaking, liming, deliming, reliming, unhairing, fleshing, bating, degreasing, scudding, bating, pickling and depickling.

Preferably, the tanning agent and/or tannery processing agents can be selected to chemically modify the animal substrate, such as, for example, by linking and locking collagen protein strands of the animal skin substrate together. The three dimensional protein structure of the animal skin substrate can be modified.

Advantageously, the apparatus and method of the invention can facilitate a deeper and more uniform penetration of tanning agents into the animal skin substrate thereby improving the preservation of the substrate compared to the methods used in the prior art.

Preferably, the process of the invention comprises applying the tanning agent or tannery process agent to the animal skin substrate wherein at least some of the tanning agent or tannery process agent so applied originates from the treatment liquor. More preferably substantially all of the tanning agent or tannery process agent so applied originates from the treatment liquor.

Preferably, the tanning or re-tanning agent is selected from synthetic tanning agents, vegetable tanning or vegetable re-tanning agents and mineral tanning agents such as chromium III salts or salts and complexes containing iron, zirconium, aluminium and titanium. All the tanning agents used may be substantially free from chromium containing compounds.

The tanning agents can be synthetic tanning agents. Suitable synthetic tanning agents include, but are not limited to amino resins, polyacrylates, fluoro and/or silicone polymers and formaldehyde condensation polymers based on phenol, urea, melamine, naphthalene, sulphone, cresol, bisphenol A, naphthol and/or biphenyl ether.

The tanning agents can be vegetable tanning agents. Vegetable tanning agents comprise tannins which are typically polyphenols. Vegetable tanning agents can be obtained from plant leaves, roots and especially tree barks. Examples of vegetable tanning agents can include the extracts of the tree barks from chestnut, oak, redoul, tanoak, hemlock, quebracho, mangrove, wattle acacia; and myrobalan.

The tanning agents can be mineral tanning agents. Particularly suitable mineral tanning agents comprise chromium compounds, especially chromium salts and complexes. The chromium is preferably in a chromium (III) oxidation state. A preferred chromium (III) tanning agent is chromium (III) sulphate.

Other tanning agents can include aldehydes (glyoxal, glutaraldehyde and formaldehyde), phosphonium salts, metal compounds other than chromium (e.g. iron, titanium, zirconium and aluminium compounds). The treatment liquor, especially for tanning, can be acidic, neutral or basic. Vegetable and chromium tanning agents are preferably used with acidic treatment formulations. The treatment liquor can preferably comprise sulfuric, hydrochloric, formic or oxalic acid in embodiments where acidic formulations are to be used.

Optionally, water in the treatment liquor has been softened or demineralized.

The treatment liquor can include one or more waterproofing agents. Examples of suitable waterproofing agents are hydrophobic silicones. In further embodiments, the treatment liquor can include one or more flame retardants. Suitable flame retardants can include, but are not limited to, titanium hexfluoride or zirconium hexafluoride. The treatment liquor can include one or more stain repellants. Suitable stain repellants can include, but are not limited to, polysulphones, waxes, salts, silicone polymers and polytetrafluoroethylene (PTFE).

As the process of the invention can be used with significantly less water than methods of the prior art, in embodiments of the invention, the quantity of chemicals or chemical loading in the treatment liquor can be reduced.

One or more phases of the treatment process of the invention can be performed at a temperature of from 0 to 100° C. Furthermore, the method can include one or more heating or cooling steps. Thus the temperature may be raised or lowered between the values of 0 and 100° C. at one or more points throughout the treatment cycle. One or more phases of the method can be performed at a temperature of from 0 to 60° C. such as from 20 to 60° C. or at a temperature of from 30 to 50 or 60° C. As the method of the invention can lead to a reduction in the duration of the treatment cycle, it is possible for the method to be operated effectively at lower temperatures. For example, in one or more phases of the treatment cycle the process of the invention can effectively be performed at ambient temperature as opposed to higher temperatures which are generally required in the processes of the prior art. Also, because smaller amounts of treatment liquor can be used the amount of energy required to obtain these temperatures can be substantially reduced.

An exemplary treatment process utilizing the apparatus 100 of the invention can now be outlined. First, the animal skin substrate is placed within the drum 10 via access means. If the apertured screen is in its use position, it can be moved away from outlet opening 14 (e.g. by sliding) to allow placement of the animal skin substrate in the drum. The apertured screen can then be returned to its use position in which it extends across the outlet opening. After the access means is closed, treatment liquor together with any treatment agents are introduced to the drum interior through drum inlet 19. In addition, solid particulate material residing in storage vessel 40 is introduced to the treatment volume through drum inlet 18 via dispenser 30. At this stage in the treatment process, the closure 20 is retained in the closed position. Treatment liquor and solid particulate material fill the drum 10 to an appropriate extent which typically allows for about 30 to 60% ullage by volume in order to provide for efficient mixing whilst maximising the utilisation capacity of the treatment process. Rotation of the drum 10 ensures agitation of the animal skin substrate with the treatment liquor and the solid particulate material. Typically, the drum 10 is rotated at 12 rpm with the outlet opening 14 closed for 15 minutes. Following agitation of the substrates with the outlet opening 14 closed, the closure 20 is then moved to an open position to permit the egress of solid particulate material and treatment liquor from the drum 10. The rotation of the drum 10 can first be stopped and then closure 20 moved to an open position. In other embodiments, an electronic controller responsively sends a signal to an actuator arranged on the drum 10 to cause the closure 20 to move from a closed position to an open position after the 15 minute agitation step. Once the closure 20 has moved to an open position, the drum 10 continues to rotate and solid particulate material and treatment liquor fall out of the drum 10 from the outlet and into the collection vessel 52.

Following transfer into the collection vessel 52, treatment liquor together with the solid particulate material is transported via the conveyor 60 to the storage vessel 40. The solid particulate material is separated from the treatment liquor by the action of separator 44. After the separation of residual treatment liquor, the solid particulate material can be re-introduced to the drum 10 through drum inlet 18 via dispenser 30. In addition, the solid particulate material can be subject to one or more washing and rinsing operations before its re-introduction to the drum 10. Whether the solid particulate material is re-introduced to the drum 10 for a further agitation step or multiple agitation steps can depend on the nature of the treatment performed on the substrate. Thus, the solid particulate material is optionally not re-introduced to the drum 10 and is simply retained in the storage vessel 40. In such embodiments, the solid particulate material can however be re-used in subsequent processes to treat additional animal skin substrates.

Furthermore, treatment liquor conveyed from the collection vessel 52 and separated from the solid particulate material can be recycled through the use of 3-way valve 70. The recycled treatment liquor can thus be re-introduced to the drum 10 via drum inlet 18 or, alternatively, drum inlet 19.

As noted above, the introduction of solid particles into the drum 10 can be ceased at an appropriate stage in the treatment process. When the flow of solid particles into the drum 10 has stopped, the drum 10 can continue to rotate and further treatment liquor can be introduced to the drum 10 with the closure in an open position. The further introduction of treatment liquor can advantageously serve to "wash off" or displace solid particles present on the surface of the animal skin substrates to promote their exit from the drum. Further (or recycled) treatment liquor can continue to be introduced in this manner for a predetermined period or until a desired separation of solid particles from the substrates has been achieved.

Depending on the treatment process performed, the drum can be rotated at different speeds. Typically, for tannery processes, the drum is caused to rotate at a speed of from 1 to 15 rpm. Particularly wherein the treatment process is a beamhouse or a tanning or a retanning or a fatliquoring or a dyeing process, the drum can be caused to rotate at a speed of from about 3 to about 14 rpm. Particularly wherein the treatment process is a beamhouse process, the drum can be caused to rotate at a speed of from about 9 to about 14 rpm.

Optionally, the drum can be caused to rotate at a speed of not more than 15 rpm or a lower rpm.

Advantageously, the treatment process when performed in accordance with the invention demonstrated highly efficient separation of solid particles from the animal substrates. The extent of separation of solid particles from the animal skin substrates can be determined by calculating the separation efficiency. The separation efficiency is preferably calculated by the following steps:

i. recovering the particulate solid material following its use in the treatment process carried out in the apparatus of the present invention or in the method(s) of the present invention;
ii. rinsing and drying the particulate solid materials recovered in step i);
iii. recording the weight of recovered particulate solid material—A;
iv. recovering the particulate solid material which remains after step i);
v. rinsing and drying the particulate solid materials recovered in step iv);
vi. recording the weight of recovered particulate solid material—B;
vii. calculating the percentage efficiency by use of the equation: Separation Efficiency (wt %)=100×A/(A+B).

Step iv can conveniently be performed by manually hand picking and shaking the remaining particulate solid material from the animal skin substrate.

The rinsing steps can be useful for removing any animal skin substrate and treatment liquor residues. Preferably, this is done by water rinsing.

The separation efficiency of solid particles from the animal skin substrate provided by the invention is preferably greater than 80%, preferably greater than 85%, more preferably greater than 90% and most preferably greater than 95%.

The above-noted processes employing the apparatus 100 can constitute a primary means of removing solid particulate material from animal skin substrates. Although the great majority (i.e. greater than 80%) of solid particles are typically removed from the animal skin substrates using the apparatus 100, any remaining solid particles can be removed by one or more further process steps. Thus, the invention also relates to secondary means of removing solid particulate material from animal skin substrates.

The applicant notes that effective removal of particulate solid particulate material from the animal skin substrate can be important such that subsequent processes or processing steps such as dyeing, fatliquoring, coating etc are not incomplete or adversely affected by the presence of the solid particulate material. For example, the presence of even small amounts of the solid particulate material can lead to surface imperfections in the finished substrate.

Figure 3:
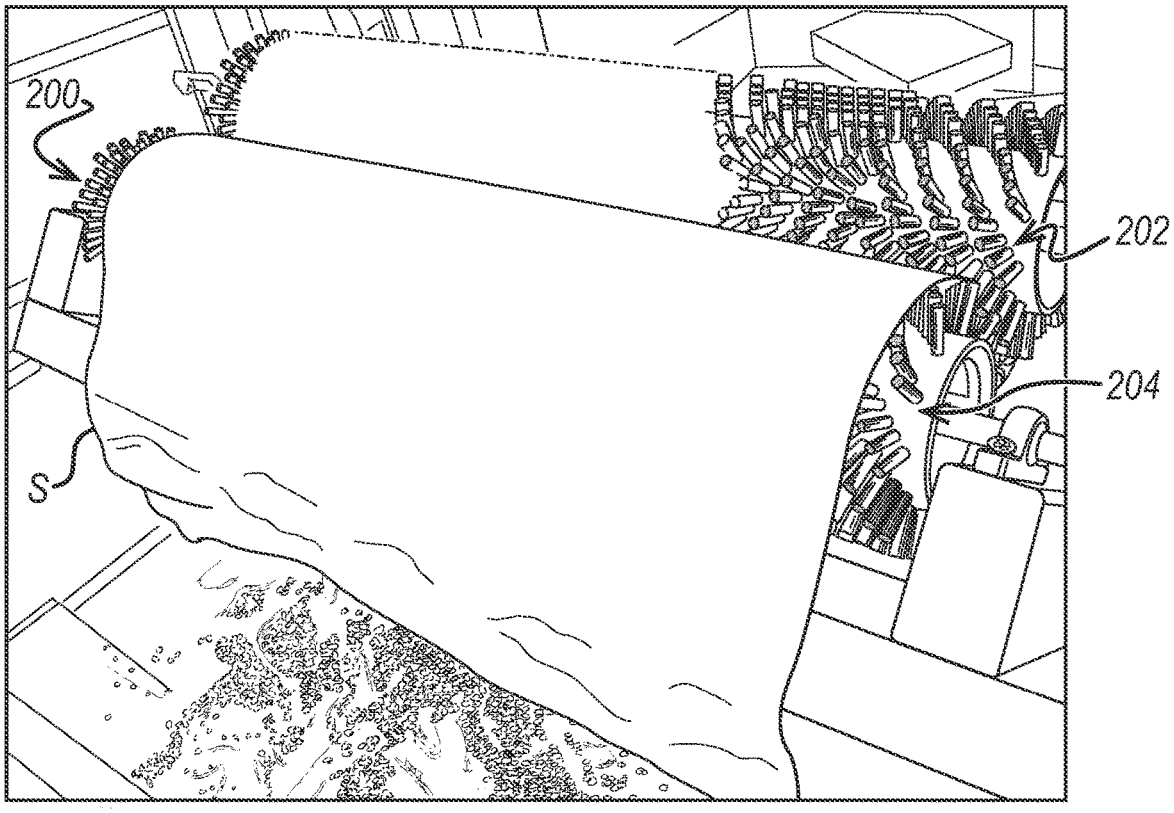
FIG. 3 is an image showing a further apparatus for removing solid particulate material from animal skin substrates according to the invention.

FIG. 3 illustrates a further apparatus 200 for removing solid particulate material from animal skin substrates. Particularly, the apparatus 200 can be used as a part of a secondary solid particulate material removal process following the treatment of the substrates in the apparatus 100. The apparatus 200 comprises first and second rollers 202, 204 between which the animal skin substrate (S) can be fed. Thus after recovery from the treatment apparatus 100, the substrates are flattened and unfolded before being passed between the rollers. Each roller can be in the form of a generally cylindrical brush having a plurality of bristles upstanding from the surface of a generally cylindrical core. As the animal skin substrate (S) is fed between the rollers, the brushes of the first roller 202 contact a lower surface of the animal skin substrate and the brushes of the second roller 204 contact an upper surface of the animal skin substrate. In this way, the use of the apparatus 200 can strip any remaining solid particles from the substrate surfaces. The brushes can advantageously be caused to rotate relative to the animal skin substrate, such as by drive means. The drive means can be manual, or more preferably can be an electric motor.

Figure 4:
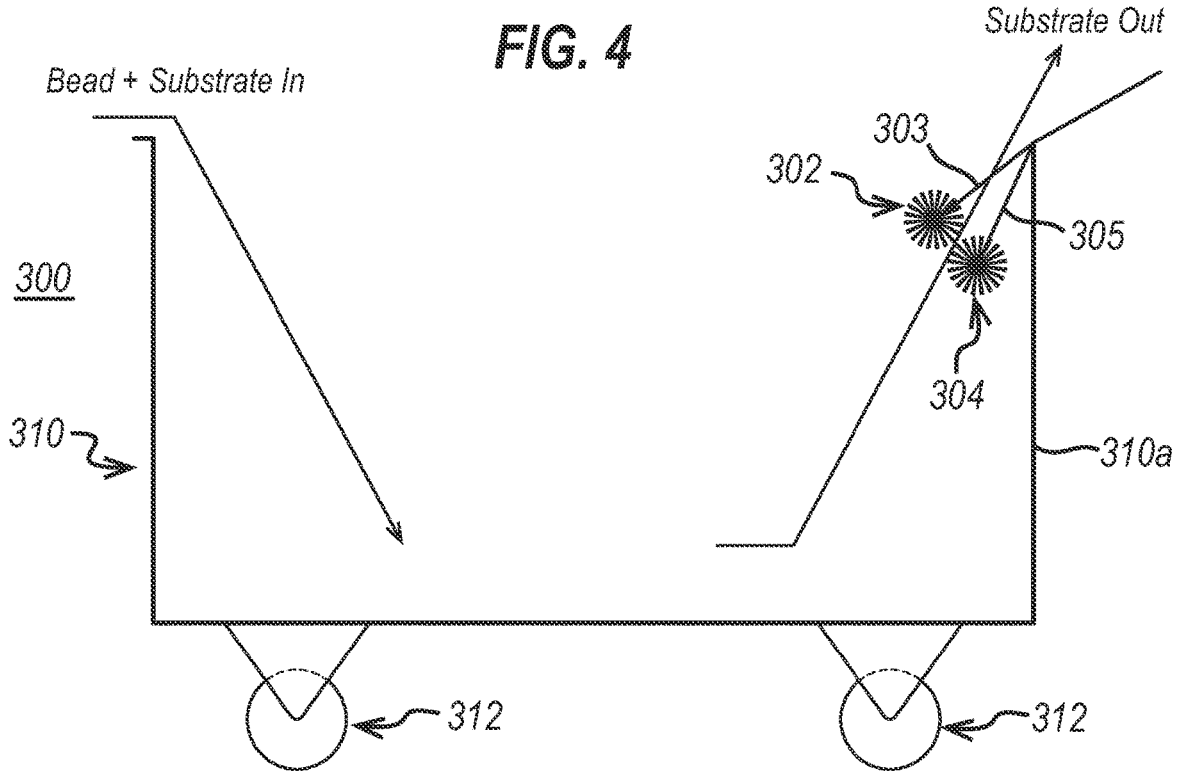
FIG. 4 shows a schematic front view of a further apparatus for removing solid particulate material from animal skin substrates according to the invention.

FIG. 4 illustrates a further apparatus 300 for removing solid particulate material from animal skin substrates. The apparatus 300 can also be used as a part of a secondary solid particulate material removal process following the treatment of the substrates in the apparatus 100. The apparatus 300 includes tub 310 which is conveniently mounted on a set of wheels 312. Apparatus 300 can thus be in the form of a trolley. The apparatus 300 comprises first and second rollers 302, 304 between which the animal skin substrate (S) can be fed. The first and second rollers 02, 304 can be of similar construction, that is, generally cylindrical brushes to the rollers 202, 204 mentioned above. The rollers are mounted to a portion of the tub 310 such that they are positioned inwardly with respect to tub sidewall 310*a*. Particularly, the rollers 302, 304 are respectively connected to roller supports 303, 305 extending from tub sidewall 310*a*.

After recovery from the treatment apparatus 100, the animal skin substrates are loaded into the tub 310. The animal skin substrate (S) can then be pulled between the rollers whereby brushes of the first roller 302 contact a lower surface of the animal skin substrate and the brushes of the second roller 304 contact an upper surface of the animal skin substrate. The brushes can advantageously be caused to rotate relative to the animal skin substrate, such as by drive means. The drive means can be manual, or more preferably can be an electric motor. Solid particulate material removed from the substrate in this manner falls into the interior of the tub 310 and can be retained for further use in additional treatment processes.

The invention will now be further illustrated, though without in any way limiting the scope thereof, by reference to the following examples and associated illustrations.

Examples

The following experiments were conducted to demonstrate that efficient separation of the solid particulate material from the animal skin substrate can be achieved by selective removal of liquids and solid particulate material through an opening in the drum of the treatment apparatus. The apparatus used included the features described and illustrated with respect to FIG. 1. In the first trial, 40 kg of treated animal skin substrate (bovine wet-blue with an approximate area of 0.3 m and a thickness around 3 mm) were mixed with 60 kg of solid particles (solid particulate material:substrate ratio 1.5:1) and 10 kg of water in an Italprogetti Ltd. (San Romano, Italy) SR-12 drum (diameter 1200 mm, width 600 mm). The solid particles comprised polyethylene terephthalate (PET) manufactured by Teknor Apex having a density of 1.365 g/cm$^3$ and an average diameter of 3.5 mm. To ensure efficient mixing of the components, the drum was rotated at 12 rpm for 15 minutes with the closure fully shut prior to commencing the bead removal experiments. Subsequently, the drum was stopped and the closure was opened (opening 5×25 cm:total bead removal area/outlet size 125 cm$^2$). The drum was then rotated at 12 rpm allowing the beads and the treatment liquor to flow into the outer jacket of the drum. After rotating the drum for one minute, the drum was stopped and the separated solid particles (collected in the outer jacket) were removed and weighed. This procedure was repeated for 30 minutes at different time intervals.

Figure 5:
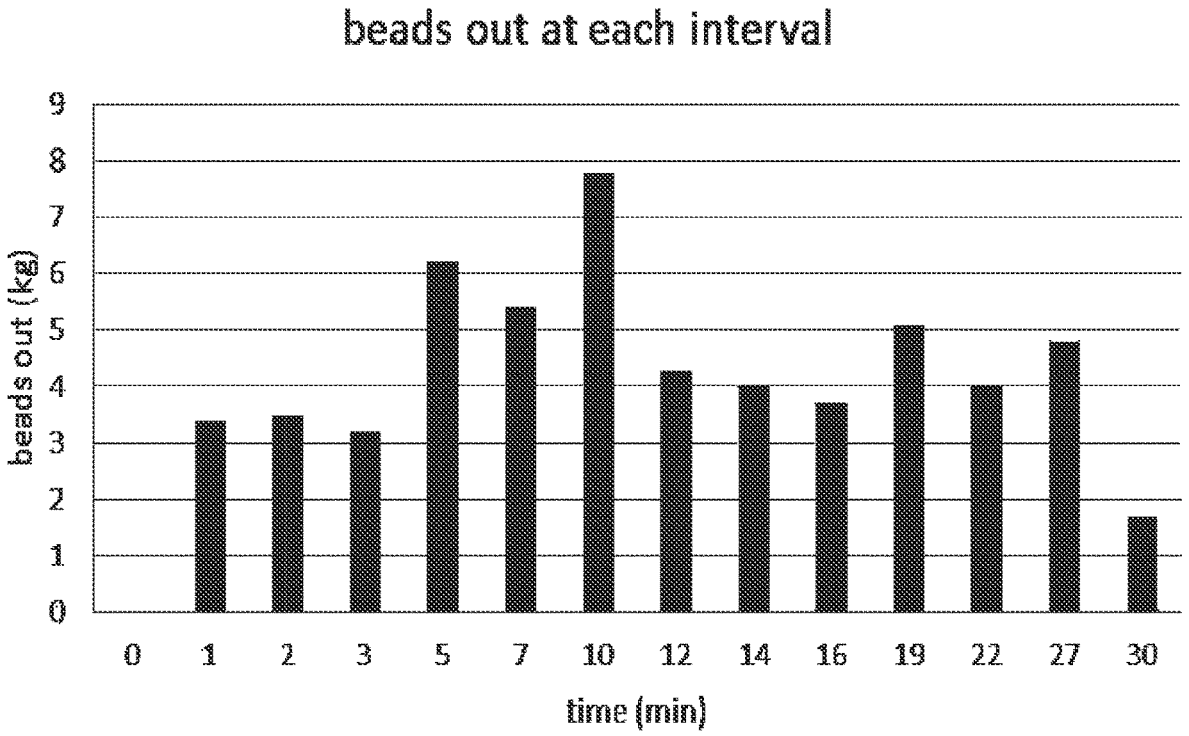
FIG. 5 is a graph showing the amount of solid particles (beads) removed via outlet of the drum at each time interval.

Referring now to FIG. 5, the graph demonstrates the weight of solid particles removed at each time interval following the opening of the closure over a 30 minute period. In the first three time intervals, the separation of solid particles from the substrate is quite low as particles can initially be entrapped between several layers of substrate. A few minutes of tumbling action can thus be required to open up the twisted substrates and direct solid particles to the wall of the drum. As the solid particles begin to move freely inside the drum, the separation rate increases and more beads exit the drum from the outlet until the solid particulate material:substrate ratio decreases to less than 1 (i.e. the weight of the substrate in the drum is more than the weight of the solid particulate material).

Figure 6:
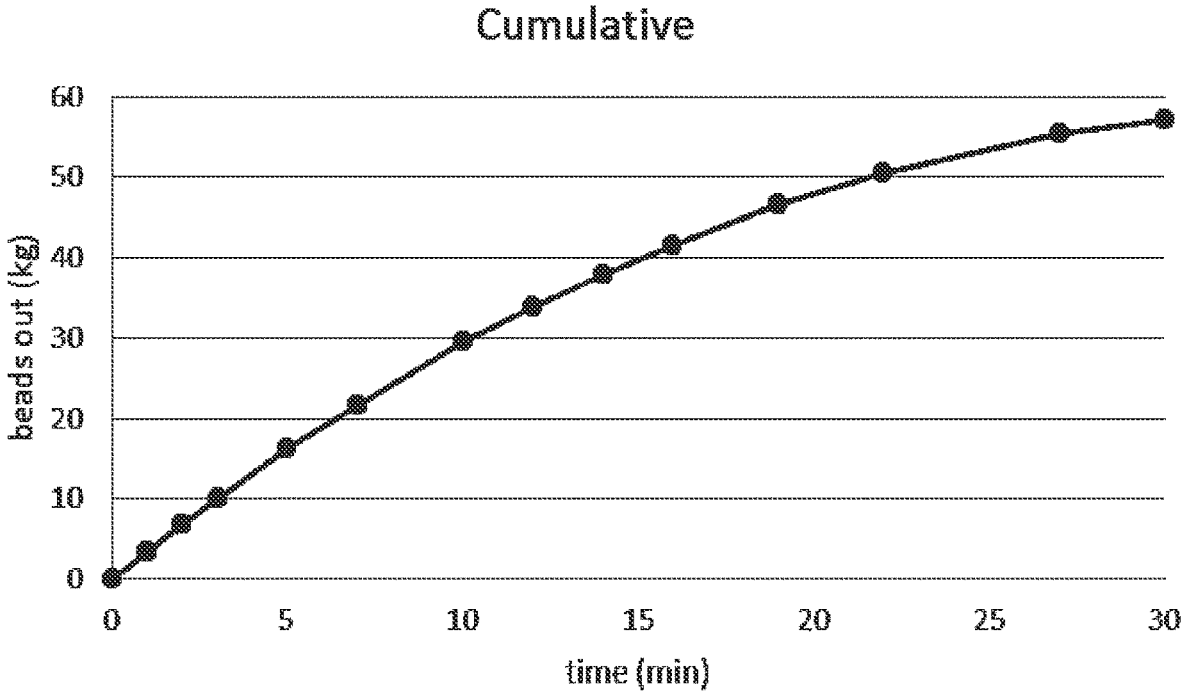
FIG. 6 is a schematic graph demonstrating the cumulative amount of solid particles (beads) removed via the outlet of the drum over a 30 minute cycle for a solid particulate material:substrate ratio of 1.5:1.

Referring now to FIG. 6, the graph shows the cumulative weight of the solid particles removed from the drum at different time intervals. The total solid particle/removal rate is higher in the first 10 minutes and starts to level out after 30 minutes. This is due to the decreased solid particulate material:substrate ratio and the reduced number of solid particles available in the drum plus the higher probability that the exit route from the outlet may become temporarily obstructed by substrates. Ultimately, after a 30 minute solid particulate material removal cycle, 57.1 kg of solid particles were separated from the substrates providing a 95.2% separation efficiency.

Figure 7:
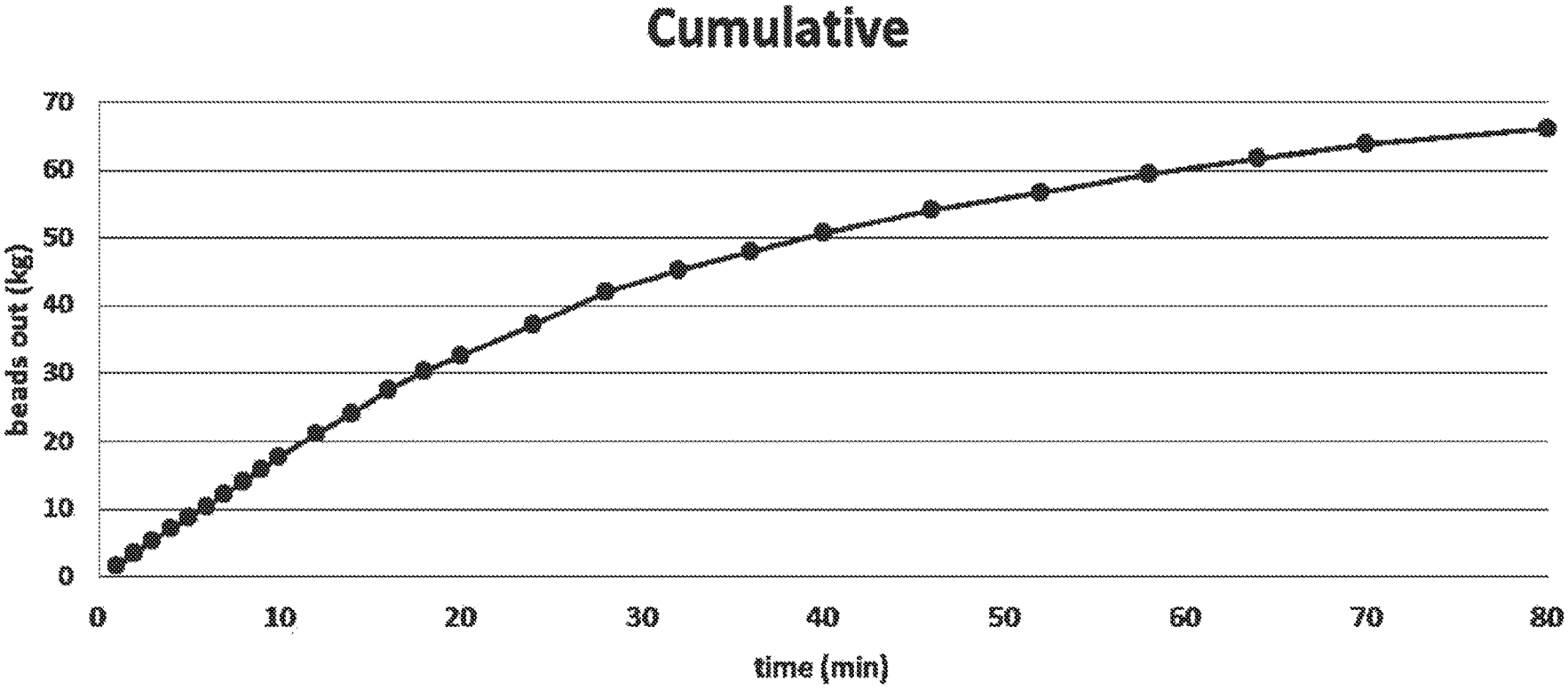
FIG. 7 is a schematic graph demonstrating the cumulative amount of solid particles (beads) removed via the outlet of the drum over a 80 minute cycle for a solid particulate material:substrate ratio of 0.9:1.

A similar experiment was conducted in the same drum (Italprogetti SR12), using the same type of substrate (bovine wet-blue) and opening size (125 cm2) but at a lower solid particulate material:substrate ratio of 0.9:1. In this experiment, the solid particulate material removal rate was reduced from its maximum value of 1.9 kg·min-1 to 0.2 kg·min-1 where after 10 minutes of constant drum rotation at 12 rpm, only 2.4 kg of solid particles were collected from the outlet. In this example, represented by the graph in FIG. 7, the probability of entrapment of solid particles between the folded and twisted substrates was thought to be higher and the number of times the exit route from the outlet was obstructed by the substrates was also considered to be increased. Consequently, at a lower solid particulate material:substrate ratio of 0.9:1, 66.1 kg out of 77 kg of solid particles initially added to the drum were separated from the substrates after 80 minutes providing a 86% separation efficiency.

In both of the above experiments, a subsequent secondary treatment using cylindrical brushes as described above resulted in complete removal of the solid particulate material from the animal skin substrate.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method of treating at least one animal skin substrate by any of curing, pretanning, tanning, re-tanning, fat-liquoring, tawing, crusting, dyeing, and dye fixing comprising agitating, for at least a first time period, the animal skin substrate with a solid particulate material and a treatment liquor in a rotatably mounted drum, opening an outlet opening of the drum, agitating the animal skin substrate in the drum for a second time period, the drum further comprising an apertured screen arranged at the outlet and configured such that during said second time period solid particulate material and treatment liquor exit the drum through the outlet opening and the at least one animal skin substrate is retained in the drum, and collecting said solid particulate material in a collecting vessel, wherein the solid particulate material comprises a plurality of particles with an average particle diameter or particle length of 1 mm to 100 mm.

2. A method as claimed in claim 1 wherein opening of the outlet opening comprises moving a closure arranged on the drum from a closed first position in which the closure covers the outlet opening to an open second position in which the outlet opening is partially covered by the closure or is not covered by the closure.

3. A method as claimed in claim 2 wherein the closure is a door slidably arranged on the drum.

4. A method as claimed in claim 2 wherein said agitating comprises rotating the drum about a substantially horizontal axis.

5. A method as claimed in claim 2 comprising transferring the collected solid particulate material from the collecting vessel to a storage vessel.

6. A method as claimed in claim 5 wherein the solid particulate material is transferred with treatment liquor which is also collected by the collecting vessel.

7. A method as claimed in claim 6 further comprising transferring the solid particulate material and the treatment liquor to a separation device and separating the solid particulate material from the treatment liquor in the separation device.

8. A method as claimed in claim 7 wherein the separation device is arranged in the storage vessel and further comprising retaining the separated solid particulate material in the storage vessel and discharging the treatment liquor from the storage vessel.

9. A method as claimed in claim 8 further comprising during said first and/or second time periods, returning, intermittently or continuously, at least some of the discharged treatment liquor to the interior of the drum via an inlet port of the drum.

10. A method as claimed in claim 8 further comprising during said first time period, returning, intermittently or continuously, at least some of the discharged solid particulate material to the interior of the drum via an inlet port of the drum.

11. A method as claimed in claim 1 further comprising treating solid particulate material collected by said collecting vessel to remove residual treatment liquor and/or residue of the animal skin substrate.

12. A method as claimed in claim 3, further comprising treating solid particulate material collected by said collecting vessel to remove residual treatment liquor and/or residue of the animal skin substrate, wherein said treating of the solid particulate material is effected before the solid particulate material reaches the storage vessel.

13. A method as claimed in claim 1 wherein the solid particulate material collected in the collecting vessel is re-used for the treatment of the animal skin substrate in the same treatment method or for the treatment of further animal skin substrates in subsequent treatments according to the method.

14. A method as claimed in claim 1 further comprising retrieving the animal skin substrate from the collecting vessel and subjecting the substrate to a secondary solid particulate material removal process for the separation of residual solid particulate material from the animal skin substrate.

15. A method as claimed in claim 14 wherein the secondary solid particulate material removal process comprises passing the animal skin substrate between opposed rotating cylindrical brushes or subjecting the solid particulate material on the animal skin substrate to removal by suction with a suction device.

16. A method as claimed in claim 1 wherein said drum is part of an apparatus for treating at least one animal skin substrate with a solid particulate material, the apparatus comprising a rotatably mounted drum for containing said animal substrate, said solid particulate material and a treatment liquor, said drum comprising an outlet opening an apertured screen arranged at the outlet opening and configured to permit passage through the outlet opening of the solid particulate material and the treatment liquor and to prevent passage through the outlet opening of the animal skin substrate, and a closure moveable between a first position at which the closure closes said outlet opening such that the animal substrate, the solid particulate material and the treatment liquor cannot pass through the outlet and a second position at which said outlet opening is open such that solid particulate material and the treatment liquor can exit the drum through the outlet opening.

17. A method as claimed in claim 16 wherein said apparatus further comprises a jacket or casing arranged externally of the drum at at least a lower portion thereof and configured to receive solid particulate material exiting the drum through the outlet opening; and wherein the apparatus further comprises a collection vessel arranged below the jacket or casing and communicating therewith to collect solid particulate material which has exited the drum.

18. A method according to claim 1 wherein the animal skin substrate is a hide or a pelt.

19. An apparatus for treating at least one animal skin substrate with a solid particulate material, the apparatus comprising a rotatably mounted drum for containing said animal substrate, said solid particulate material and a treatment liquor, said drum comprising an outlet opening;

an apertured screen arranged at the outlet opening and configured to permit passage through the outlet opening of the solid particulate material and the treatment liquor and to prevent passage through the outlet opening of the animal skin substrate;

a closure moveable between a first position at which the closure closes said outlet opening such that the animal substrate, the solid particulate material and the treatment liquor cannot pass through the outlet and a second position at which said outlet opening is open such that solid particulate material and the treatment liquor can exit the drum through the outlet opening;

wherein the apparatus further comprises a jacket or casing arranged externally of the drum at at least a lower portion thereof and configured to receive solid particulate material exiting the drum through the outlet opening; and wherein the apparatus further comprises a collection vessel arranged below the jacket or casing and communicating therewith to collect solid particulate material which has exited the drum.

20. Apparatus as claimed in claim 19 wherein the apertured screen is moveable from the outlet opening to permit loading and unloading of the animal skin substrate through the outlet opening when the closure is in the second position.

21. Apparatus as claimed in claim 19 wherein the drum is a substantially cylindrical drum comprising a substantially cylindrical side wall and opposed end walls and wherein the outlet opening is arranged in said cylindrical side wall.

22. Apparatus as claimed in claim 21 wherein the drum is configured to rotate about a substantially horizontal axis.

23. Apparatus as claimed in claim 19 further comprising a drive arrangement configured to rotate the drum and a drive controller configured to control the operation of the drive arrangement.

24. Apparatus as claimed in claim 19 wherein the apertured screen is a reticulate screen or a perforate screen.

25. Apparatus as claimed in claim 19 wherein the closure comprises a slidably arranged door which is slidably moveable between the first position in which the door covers the outlet opening and a second position in which the door partially covers the outlet opening or does not cover the outlet opening.

26. Apparatus as claimed in claim 19 further comprising a storage vessel arranged externally of the drum to retain solid particulate material prior to entry thereof into the drum and/or solid particulate material recovered from the drum.

27. Apparatus as claimed in claim 26 further comprising a feed conduit extending from the storage vessel to the drum and a control arrangement to control the feed of solid particulate material from the storage vessel to the drum.

28. Apparatus as claimed in claim 26 further comprising a transport conduit configured to transport solid particulate material from the collection vessel to the storage vessel.

29. Apparatus as claimed in claim 28 further comprising a separator arranged to separate the solid particulate material from treatment liquor.

30. Apparatus as claimed in claim 29 wherein the separator is arranged within the storage vessel.

31. Apparatus as claimed in claim 19 further comprising at least one product inlet distinct from the outlet opening and configured for the supply of solid particulate material and/or treatment liquor into the drum.

32. Apparatus as claimed claim 19 wherein the apparatus is adapted for re-use of the solid particulate one or more times for treatment of the animal substrates in, with or by the apparatus.

* * * * *